US010060638B2

(12) United States Patent
Fischer et al.

(10) Patent No.: US 10,060,638 B2
(45) Date of Patent: Aug. 28, 2018

(54) CHILLED BEAM PUMP MODULE, SYSTEM, AND METHOD

(71) Applicant: SEMCO LLC, Columbia, MO (US)

(72) Inventors: John C. Fischer, Marietta, GA (US); Kirk T. Mescher, Columbia, MO (US); Richard K. Mitchell, Columbia, MO (US); Stephen P. Glen, Higbee, MO (US); Steven S. Carroll, Columbia, MO (US)

(73) Assignee: SEMCO LLC, Columbia, MO (US)

( * ) Notice: Subject to any disclaimer, the term of this patent is extended or adjusted under 35 U.S.C. 154(b) by 0 days.

(21) Appl. No.: 15/453,717

(22) Filed: Mar. 8, 2017

(65) Prior Publication Data

US 2017/0205088 A1 Jul. 20, 2017

Related U.S. Application Data

(63) Continuation of application No. 13/757,319, filed on Feb. 1, 2013, now Pat. No. 9,625,222.

(60) Provisional application No. 61/594,231, filed on Feb. 2, 2012.

(51) Int. Cl.

| | |
|---|---|
| ***G05D 23/00*** | (2006.01) |
| ***F24F 3/08*** | (2006.01) |
| ***F24D 3/02*** | (2006.01) |

(52) U.S. Cl.

CPC . *F24F 3/08* (2013.01); *F24D 3/02* (2013.01)

(58) Field of Classification Search

CPC ..... F24F 2011/0054; F24F 2011/008; F24F 2011/0082; F24F 2011/0083; F24F 5/0003; F24F 5/0089; F24F 5/0092; F28F 27/00

See application file for complete search history.

(56) References Cited

U.S. PATENT DOCUMENTS

| | | | |
|---|---|---|---|
| 3,069,867 | A | 12/1962 | Ringquist |
| 3,127,929 | A | 4/1964 | Ringquist |
| 3,170,508 | A | 2/1965 | Avery |

(Continued)

FOREIGN PATENT DOCUMENTS

| | | |
|---|---|---|
| DE | 1389256 | 4/1975 |
| EP | 1795825 | 6/2007 |

(Continued)

OTHER PUBLICATIONS

JP2001-215037 "Ryobi", Machine Translation.

(Continued)

*Primary Examiner* — Travis Ruby
(74) *Attorney, Agent, or Firm* — Allan Watts

(57) ABSTRACT

Multiple-zone chilled beam air conditioning systems for cooling multiple-zone spaces, methods of controlling chilled beams in multi-zone air conditioning systems, and chilled-beam pump modules for controlling zones of a chilled-beam heating and air conditioning system. Embodiments include a pump serving each zone that both recirculates water within the module and chilled beam and circulates water in and out of a chilled water distribution system through one or more valves to control the temperature of the water delivered to the chilled beams. Different embodiments adjust the temperature of the beam to avoid condensation, change pump speed to save energy or increase capacity, provide heating as well as cooling, use check valves to reduce the number of control valves required, can be used in two- or four-pipe systems, or a combination thereof.

20 Claims, 4 Drawing Sheets

(56) References Cited

U.S. PATENT DOCUMENTS

| | | | |
|---|---|---|---|
| 3,176,759 | A | 4/1965 | Windham |
| 3,256,929 | A | 6/1966 | Carlson |
| 3,288,205 | A | 11/1966 | Egbert |
| 3,303,873 | A | 2/1967 | Ringoulst |
| 3,378,062 | A | 4/1968 | Ringqulst |
| 3,384,155 | A | 5/1968 | Newton |
| 3,425,485 | A | 2/1969 | Newton |
| 3,685,574 | A | 8/1972 | Worms |
| 3,693,704 | A | 9/1972 | Newton |
| 3,910,345 | A | 10/1975 | Whalen |
| 4,067,383 | A | 1/1978 | Padden |
| 4,150,788 | A | 4/1979 | Matsumoto |
| 4,456,456 | A | 6/1984 | Pompei |
| 4,475,932 | A | 10/1984 | Hull |
| 4,555,253 | A | 11/1985 | Hull |
| 4,718,478 | A | 1/1988 | Huber |
| 4,903,503 | A | 2/1990 | Meckler |
| 4,987,748 | A | 1/1991 | Meckler |
| 5,131,238 | A | 7/1992 | Meckler |
| 5,181,387 | A | 1/1993 | Meckler |
| 6,945,324 | B2 | 9/2005 | Weng |
| 8,397,799 | B2 | 3/2013 | Blecker |
| 2008/0112128 | A1 | 5/2008 | Holland |
| 2010/0181062 | A1 | 7/2010 | McCann |
| 2010/0236772 | A1 | 9/2010 | Novotny |
| 2010/0242726 | A1 | 9/2010 | Enbom |
| 2011/0155354 | A1 | 6/2011 | Karamanos |
| 2013/0240172 | A1 | 9/2013 | Reilly |
| 2015/0369494 | A1 | 12/2015 | Skovmose Kallesoe |

FOREIGN PATENT DOCUMENTS

| | | |
|---|---|---|
| JP | H0783466 | 3/1995 |
| JP | H09166346 | 6/1997 |
| JP | H09210426 | 8/1997 |
| JP | 2001215037 | 8/2001 |
| KR | 20100128374 | 12/2010 |
| KR | 1020110038927 | 4/2011 |

OTHER PUBLICATIONS

ISR and Written Opinion for Corresponding Int'l Application No. PCT/US2013/024401 dated Mar. 29, 2016.

Air Commodities Inc., Chilled Beam Design Guide. TROX Technik (TB20209) printed Oct. 13, 2011 See pp. 19-26.

ITT Corporation, Bell & Gossett Instruction Manual G95873, Rev. L, Circuit Setter Plus Balance Valves With NPT, Flanged and Solder Connections Aug. 1, 2009.

FlaktWoods, Precise Air Management. Product Range > Chilled Beams Sep. 1, 2008.

Taco Inc., LoFlo injection pumping Feb. 10, 2011.

Chilled Beam Design Guide, TROX Technik (TB031412).

Neuton Technical Guide, SEMCO, 2015.

Neuton Controlled Chilled Beam Pump Module, SEMCO, 2015.

EESR for EP 13744287.7.

TRO/TECHNIC Chilled Beam Design Guide.

Pinnacle Chilled Beam Application Guide, SEMCO.

IAQ, Total Energy Recovery, Passive Dehumidification and Chilled Beam Technologies, SEMCO.

CHILLED BEAM PUMP MODULE, SYSTEM, AND METHOD

RELATED PATENT APPLICATIONS

This patent application is a continuation of, and claims priority to, U.S. patent application Ser. No. 13/757,319, CHILLED BEAM PUMP MODULE, SYSTEM, AND METHOD, filed on Feb. 1, 2013, which is a non-provisional patent application of, and claims priority to, Provisional Patent Application No. 61/594,231, filed on Feb. 2, 2012, titled CHILLED BEAM PUMP MODULE, SYSTEM, AND METHODS, each having at least one inventor in common and the same assignee. In addition, the contents of these priority patent applications are incorporated herein by reference. Certain terms, however, may be used differently in the priority Provisional Patent Application.

FIELD THE INVENTION

This invention relates to chilled beam heating, ventilating, and air conditioning (HVAC) systems and components and equipment for such systems and to methods of configuring and controlling chilled beam HVAC systems. Particular embodiments relate to multi-zone chilled-beam systems. Some embodiments both cool and heat.

BACKGROUND OF THE INVENTION

Active chilled beams provide an energy-efficient way to provide sensible cooling to a space. High energy efficiency can be achieved by accomplishing most of the space sensible cooling utilizing moderate temperature chilled water while minimizing the airflow ducted to the space. In a number of embodiments, the outdoor ventilation airflow is the only blown air used to provide all of the cooling and heating energy to the space. Typically, this airflow may be only 25%-35% of that used by conventional cooling systems (i.e., VAV or fan coil systems) thereby saving significant fan energy. Active chilled beams can deliver this relatively small outdoor or primary airflow though slots or nozzles within the beam to cause induction of room air through the integrated coil. In a typical application, this "induced room air" may be 3-4 times the primary airflow volume, so the final airflow volume delivered to the room may be similar to that delivered by convention cooling systems, but only a fraction of the fan horsepower may be used. Excellent indoor air quality can be achieved, in various embodiments, using active chilled beams since outdoor air is ducted directly to the individual zones and is provided continuously. In certain embodiments, active chilled beams also provide the benefit of very low noise generation, making them well suited to meet the more stringent sound criteria recently incorporated into building codes for applications such as school classrooms. They may also benefit from ideal airflow distribution and eliminate drafts common with conventional forced air systems.

Passive beams, on the other hand, do not have air connections, and thereby do not deliver nor induce airflow. They incorporate a chilled coil or plate and rely on natural convection and radiant heat transfer to condition the space. They typically work with a reverse chimney effect, meaning that the cooler air near the beam's chilled surface has a higher density than the surrounding air and therefore the cool air flows downward to the occupied space. A common feature of typical active and passive chilled beams that both cool and heat is that they require chilled or hot water to be passed through the device to function, involve a significant amount of costly chilled and hot water piping, require careful control over the chilled water temperature, and air flow serving the beams and the space served by the beams must be effectively dehumidified to avoid condensation.

In a typical chilled-beam system, very cold water is created by the chiller typically having a temperature of about 45 degree F. The very cold water in the "primary chilled water loop" is delivered directly to the primary air handling system that produces the primary airflow that is delivered to the active chilled beams, often referred to as a dedicated outdoor air system (DOAS). This primary air system typically requires this very cold water in order to dehumidify the primary air delivered to the beams to the level appropriate to handle all of the space latent load (humidity) associated with the occupants, infiltration and other moisture sources. Lower than normal supply dew point air is required since these internal latent loads are accommodated using the relatively low primary airflow volume at each zone. Effective space humidity control can be important for many chilled-beam system applications to avoid condensation on the coils since they are most commonly designed to be 100% sensible-only devices.

In some embodiments, very cold refrigerant leaving the chiller is passed through a heat exchanger before being returned to chiller for re-cooling. A portion of the water from the secondary water loop is passed through the secondary side of the plate frame heat exchanger to create the moderate temperature chiller water required by the chilled beams. Typically, the water temperature delivered to the chilled beams will be much warmer than delivered to the DOAS system which supplies dehumidified outdoor air to the active chilled beams to avoid condensation on the coil surfaces, the chilled water pipes, control valves and other devices that are part of the chilled-beam system. Water in the range of 56 to 60 degrees F. is commonly used with 58 degrees being typical. To create and maintain this 58 degree F. water that is delivered via the secondary water loop to the chilled beams, a 3 way modulating control valve is commonly used to distribute a portion of the warmed water that has returned from the secondary water loop after leaving the chilled beams through the heat exchanger while also diverting (bypassing) the remainder of the secondary loop return water around the heat exchanger. These two streams are typically mixed before entering the secondary water loop pump.

To determine the proportions of water that goes through the heat exchanger and the portion that is bypassed, the three way modulating valve can be controlled by a temperature sensor measuring the temperature of the water leaving the secondary water loop pump. The 58 degree F. secondary chilled water can be pumped through the supply water pipe loop which carries this water at a constant temperature through all of the zones, distributing the volume of water as needed to the beams in each zone, zone after zone, until the supply water loop reaches the very last zone where the last bit of supply water is injected into the final beams. This marks the end of the supply water loop in this example.

Based on a call for cooling from the zone thermostat, in this particular example, a two-way valve can be fully opened allowing the water to pass from the secondary chilled water supply loop, through the coils contained within the chilled beams, and into the secondary chilled water return loop. In this way, the designed flow of 58 degree water is passed through the chilled beams to provide the cooling to the zone. This chilled water continues to pass through the beams at full flow, regardless of the space load, until the space control set point, plus any applicable dead band, is reached. At this point the two way control valve is closed and the water flow is stopped until there is a need for additional cooling.

In this example of a typical state-of-the-art chilled beam design, a secondary chilled water return loop pipe is installed adjacent to the secondary chilled water supply loop such that there are two distinct pipe branches (two pipe loop) run throughout the building, just for the chilled water. As with the supply loop, the water leaving the chilled beams in the last zone is injected into the secondary chilled water return loop and the volume of water continues to build until the full system flow is returned to the 3 way modulating valve to begin another circuit. The approximate 58 degree F. water entering the chilled beams in the various zones picks up heat energy as it cools the individual zones as a result of the relatively warm room air (typically 76 degrees) passes over the coils contained within the active chilled beams throughout the building. As a result, the secondary chilled water return loop water temperature returning back to the 3 way modulating valve and water loop pump is typically warmed to a temperature of about 64 degree F.

Although some chilled-beam systems provide cooling only, various chilled beams, both active and passive, can provide heating as well as cooling. When heating is required, the current state-of-the-art design uses a coil that has "4 pipes" rather than two as described for cooling-only applications. The coil has a cold water inlet and a cold water outlet in addition to a hot water inlet and a hot water outlet (i.e., 4 pipes). Typically, an eight-pass coil, that would be used in a cooling-only beam to provide the maximum cooling output, is modified to allocate six passes for cooling and two passes for heating. This results in a significant reduction in potential coil cooling power (typical reduction of about 15%-20%) while providing adequate heating capacity in most cases, since the required heating energy (BTUs) is most often considerably less than the cooling capacity needed. This is logical since the sensible heating load provided by the people and lighting is provided to the space whether in cooling or heating mode (i.e., a heating credit).

When heating is added, another heat exchanger can be added as part of the boiler system to condition the warm water (typically in the range of 100 degrees F.) to the beams. Typical heating loop water temperatures (say 140 degrees F.) should not be provided to the beams when in heating mode, in many applications, since the low velocity air leaving the beams can result in stratification which compromises both comfort of the occupants and the heating efficiency of the coils in the heating beams. Consequently, another separate secondary heating water loop (supply and return) in addition to that required for the cooling loop, is typically required for the beam distribution system, involving a duplication of pipe, control valves, 3-way valve, and pump, as examples. In addition, controls and power need to be connected to all valves, and pipes must be insulated and balanced for both the entire cooling and heating portion of the beam system.

While effective, there are a number of limitations and problems with the current state-of-the-art chilled-beam system design. Some of these limitations are considered major barriers by many engineering design firms, causing them to continue the use less energy efficient conventional HVAC systems. First, the current state-of-the-art solution requires two separate chilled water loops—one for the chilled beams and one for the DOAS system delivering the air to the chilled beams. This is due to the water temperature required by each system. To accomplish the dehumidification required by the outdoor/primary airflow to the beams, a low supply air dew point in the range of 45 to 50 degrees F. is required. As a result, the water temperature delivered to the coil within the DOAS has to be in the range of 40 to 45 degrees, depending upon the type of DOAS used and the project space latent loads. As previously mentioned, to avoid condensation on the beams and to optimize cooling comfort (avoid dumping of cool air and drafts), the water temperature delivered to the chilled beams typically needs to be in the range of 56 to 60 degrees F. A similar situation exists for the hot water loops. The DOAS and other hot water needs may require a much hotter water temperature than desired for optimum performance of the beams. This duplication of water loops and associated cost has proven to be a significant barrier to acceptance and use of chilled-beam technology. As a result, it would be beneficial if only one water loop was required for both the DOAS and the chilled beam network.

Second, in many applications, the greatest incremental cost of a chilled-beam system is the material and installation cost associated with the water piping. Since the current state-of-the-art chilled-beam system design involves both a supply and return piping network throughout the building for each of the hot and cold water lines, and these four runs of distribution piping commonly are copper, the cost is considerable. Adding to the problem of high cost associated with the current approach, the size/diameter of the pipe must be relatively large to accommodate the high water flows associated with the moderate chilled and hot water temperatures required by the beams. For example, the water entering the chilled beam at say 58 degrees F. and leaving at 64 degree F. (6 degree delta temperature) requires three times the water flow to accomplish the same cooling power as a system designed to deliver water at 46 degrees and leaving at the same 64 degree temperature (18 degree delta T). Putting this in terms of pipe size, a pipe having the diameter of 2" delivering chilled water at 46 degrees would have to be increased to approximately 3.5" in diameter.

The difference in the cost of the pipe, connectors, valves and all other components and associated labor needed to accommodate this increase in pipe size over that typically used by more conventional technologies is much higher than what many design engineering firms and/or owners are willing to invest. A similar increase in pipe size is associated with the need to use 100 degree water, for example, for heating vs. typical hot water loop temperatures in the range of 140 degrees. This high cost of chilled and hot water piping has proven to be a barrier to acceptance and use of chilled-beam technology. As a result, it would be beneficial, in a number of applications, if fewer pipe loops, pipe having a smaller size, or both, could be employed.

Third, since water must be pumped at a relatively-high flow rate (due to the moderate delta T discussed previously), through both the supply and return water distribution pipe networks, for both cooling and heating, plus the zone piping to the beams, the coils and series of valves, the pumping energy can be relatively high. Since the current state-of-the-art chilled beam design utilizes an on/off control valve, the flow through the beams is constant and capacity control (when the spaces need less heating or cooling) is accomplished by cycling the water to the beams on and off. So, at peak cooling, all of the beams are delivered the full water flow and the main pump must provide this high pressure at the full flow.

Further, the use of a single pump to provide water to all zones can be both limiting and problematic. For example, the pump must provide as much static pressure as is required by the last zones on the system (those furthest from the pump). If this zone has, for example, more sensible loads than other zones (e.g., top floor with more windows) then the scheduled water flows for these beams, and thereby the water pressure loss through the coils, will be high. To overcome this pressure loss and drive the water through the coils, the main pump pressure must be increased for the entire system requiring a significant increase in energy as a result. Another common problem is that the installation of the piping and valves, due to jobsite limitations, is often less than ideal (e.g., more bends and turns than the original design) which adds pressure loss to the system which must be overcome by the main pump. Likewise, should the loads be under-estimated in a zone or if the use of the zone changes (e.g., an overcrowded school moves more children into a classroom than design) more cooling will be required. The main pump may not have the capacity to increase the pressure through the entire system to accommodate the peak load in a problematic zone or zones that need additional cooling.

Another challenge is that much of the pressure loss within the main chilled beam distribution piping can occur between the main supply water distribution pipe and the main return water pipe. This includes the chilled beams, the valves, and the piping connected to the beams. In many cases, the pipe connecting the beams to the main water lines is done in flexible PEX type tubing using special connectors that reduce installation labor but often increase the pressure loss through the system. Yet another limitation is that the water flow to each zone has to be measured and balanced so that the chilled beams get the design flow of water in both the heating and cooling modes. This is commonly done at or near the two-way control valve previously mentioned. Often this is accomplished by adding restriction to control flow or using a flow regulation valve rated for the water flows desired. In both cases, the devices set the flow at a fixed water pressure provided by the main circulation pump, and in the case of the flow regulation valve, ensuring that the flow does not exceed the design value. In cases where the system efficiency could benefit from a variation, however, either up or down, of the water flow to the beams, for either efficiency reasons or capacity boost, this can not be accomplished with the prior art design approach. For all of these reasons, it would be beneficial to provide localized pumping at each zone to provide added capacity or pressure as needed or to benefit from lower pressure losses, for example with reduced flow, for energy efficiency reasons. This concern regarding how to increase the heating or cooling capacity at the zone at the end of the piping system has proven to be a barrier to acceptance and use of chilled-beam technology.

Fourth, perhaps the most significant barrier to acceptance of the chilled-beam technology in moderately or severely hot and humid climates, commonplace in the US and Asia, is the concern for condensation on the beams. Most of the higher performing chilled beam products are designed to have the coils within the beams operate as sensible-only devices (i.e., no moisture removal) so that they can be installed throughout the occupied space without the installation of a drain pan and eliminating the high cost of condensation collection piping. While there are many advantages to operating chilled beams as sensible-only devices, should condensation occur, allowing water to drip directly into the occupied space, it would be a very serious problem in most applications and is typically unacceptable.

The primary line of defense for prohibiting condensation at the beams is to provide enough primary air, at a low enough humidity level, so that the space dew point is always maintained below the water temperature entering the beams during the cooling mode. With proper engineering design, load estimates, and effective DOAS equipment, this can be accomplished. Design errors can occur, however. Also, not all possible condensing scenarios can be avoided in this fashion. For example, if a door or window to a space served by the chilled beams is allowed to be open during a humid day, the space dew point can rise above the design point despite the delivery of the design quantity of dehumidified primary air.

Another common scenario is when a room is occupied with many more people than was used to determine the design primary airflow quantity and dew point. An overcrowed classroom or meeting room are two good examples of this occurrence. A third and very common scenario where the space humidity could rise to the point of causing beam condensation is during times of extreme outdoor heat and/or humidity. If the DOAS is sized to deliver air at a certain dew point at a moderate design condition, and this condition is exceeded, or if the condenser side efficiency of the chiller system is impacted, or the chilled water temperature rises slightly—all of which are common—the supply air dew point of the primary air delivered to the space by the chilled beams will increase. In all these cases, condensation could occur.

A prior chilled-beam system design addresses this issue by installing a condensation (moisture) sensor on the surface of the chilled water pipe serving the chilled beams in each zone. If the dew point is high enough to cause condensation at the monitored point, the liquid water creates a circuit sending a signal confirming condensation which is then used to close the control valve serving all beams in the zone. While, when working properly, this approach can provide a level of protection against dripping water from the beams into the occupied space, it immediately cuts all cooling provided by the chilled beams to the occupied space, which is often not acceptable to the users of the space nor considered an acceptable solution by many design engineers. In many of the scenarios mentioned above—meeting room, over-crowded classroom, and an open door for a short period of time—it is desired that cooling still be provided to the space despite a modest rise in space dew point. For all of these reasons, it would be highly beneficial, in many applications, to provide an active condensation control system for chilled beams that can respond to limit the risk of condensation while simultaneously providing effective cooling to the occupied space. This concern regarding condensation on the beams and how to avoid eliminating cooling in response to a condensation signal has proven to be a barrier to acceptance and use of chilled-beam technology.

As described previously, when a state-of-the-art chilled-beam system was designed to provide both heating and cooling, the circuiting of the coils within the beam were modified to reduce the number of cooling passes to allow for heating passes. In climates and buildings where there is a modest heating load, it is common to change a coil that would have, for example, 8 total passes, to provide 6 passes for cooling and 2 passes for heating. In colder climates, however, it is not uncommon for the coil to be changed so that 4 passes are used for heating and 4 passes are used for cooling. Increasing the number of cooling passes from 6 to 8 improves the cooling power output (BTUs) from the coil by approximately 15-20%. Increasing the number of passes from 4 to 8 improves the coil output by up to 30% at typical design conditions. Therefore, when coil passes are allocated for heating and the number of cooling passes are decreased, the amount of cooling that can be delivered by the chilled beam at a given design point (e.g., primary airflow, water temperature, water flow rate) is substantially reduced. There are few viable options to make up for this loss of performance. The primary airflow can be increased to provide more cooling associated with the air delivered to the room, but this is a costly solution since it involves both fan energy and more conditioning at the DOAS. Lowering the water temperature would provide added cooling output, but doing so increases the risk of condensation at the beams and, with the state-of-the-art design, means that this lower water temperature is provided to all zones. The colder water temperature to the beams would require drier air from the DOAS which also increases energy consumption.

The most viable option with the prior art design to compensate for the reduced beam capacity associated with fewer cooling passes may be to both increase the water flow to the beam and increase the length of the beam. Increasing the water flow enough to improve performance in the amount appropriate to counter the loss associated with reduced cooling passes, however, has a significant impact on the energy consumed by the main system pump. Increasing the beam length is the best option with regard to energy efficiency, but the cost of each beam would be increased by 15% to 25% and there is a practical limit to how much ceiling area can be allocated for the beams since light fixtures typically must also be effectively accommodated. In addition to the higher cost associated with increasing the length of the beam, there is also a significant cost associated with changing the coil to allow for both heating and cooling. In fact, increasing the length of a chilled beam by 25% and adding both heating and cooling capacity to the coil would typically double the cost of the chilled beam when compared to a beam where all passes could be used for both cooling and heating. For all of these reasons, it would be highly beneficial to have a system that allows all passes of the coil within the chilled beam to be utilized for either heating or cooling, since it would result in the use of fewer or shorter beams, at a lower cost, to provide the equivalent amount of cooling/heating output as longer 4 or 6 pipe beams.

Further, the current state-of-the-art chilled-beam system layout (as described) employs a constant flow volume of water to the beams maintained at a constant temperature, and the only method of control is to turn the flow on or off. Therefore, full cooling or heating capacity is provided as the control valve opens and closes in response to a space temperature sensor. As a result, very little flexibility is provided to accommodate varying load conditions. For example, should a room experience a heat gain that is greater than design due to increased occupancy, higher than anticipated solar load or degradation to the chilled or hot water temperature, there is no way for the system to respond. Once opened, the maximum cooling or heating capacity is recognized and there is no way to deliver more.

Conversely, when the room is at part load conditions, where occupancy is low or when the solar load is reduced (e.g., cloudy day) the only way to reduce the cooling load is to repeatedly cycle the flow to the beams on and off. While this addresses the lower cooling requirement, it does so in a way that does not efficiently use pump energy and there can be more frequent than desired swings in room temperature. There have also been complaints of nuisance noise associated with the control valves turning on and off associated with the initial in-rush of high pressure water. Since chilled beams are otherwise a very quite technology, this noise is easily detected and is not easily remedied.

During heating, when the zones are occupied and lights are on, the amount of heating required relative to the cooling energy (BTUs) needed at peak conditions is relatively low. As a result, the state-of-the-art beam design for the heating system is typically based upon a much lower water flow to the beams in an attempt to save piping cost (lower flow smaller diameter pipe) and to match the beam capacity to the occupied room load. This can be problematic, however, if the control system uses a night setback temperature that requires a rapid morning warm up mode (i.e., higher heating output on a temporary basis). A similar problem exists during unusually cold days when the envelope heat losses from the building are greater than design. For all of these reasons, it would be highly beneficial to have a chilled beam water distribution and control system that could respond to extreme cooling or heating load conditions by providing a boost mode to increase the output from the beams. It would also be highly beneficial to have a chilled beam water distribution and control system that could respond to part load and low load conditions in a more energy efficient manner and avoid the nuisance noise associated with the repeated opening and closing of the on/off control valve used by the current approach.

Even further, for optimizing energy efficiency, there is a strong desire to reduce the amount of outdoor/primary airflow delivered to the building spaces via the chilled beams during times of low occupancy or no occupancy. Going back to a typical school example, most weekends, evenings and summer months, the school remains mostly unoccupied. In such cases, very little ventilation air is required—potentially, only that needed for building pressurization to avoid high humidity infiltration loads. Likewise, since the building is unoccupied, the amount of heat normally generated by the lights and people is removed from the space, so only a small fraction of the peak cooling output from the beams is required. Some cooling may still be required, however, to maintain minimum setback conditions. In addition, there are many reasons why certain rooms might be in normal use during any of the common unoccupied periods cited, and the system may need to respond to the individual cooling and heating needs of these spaces.

Active chilled beams require a minimum amount of air for them to function effectively. As importantly, in a number of applications, the primary airflow is the only viable source of space dehumidification and adequate supply must be provided at all times for this purpose. Therefore, the primary airflow typically should not be turned off completely, in a number of applications, but it can typically be reduced, for example, by approximately 50-60%. At these levels, the desired cooling capacity can typically still be provided, since the zone sensible load is greatly reduced during unoccupied periods, with significant fan energy savings being recognized. For example, cutting the supply and return airflows to a 5,000 cfm DOAS operating at a total static pressure per airstream of 4" by 60% reduces the fan electrical energy by more than 90% (6.25 KW vs. 0.4 KW).

While the potential energy savings are significant, the VAV enhancement presents serious challenges to the current chilled-beam system design approach. As mentioned, if the airflow reduction is too low to handle the space latent load, the space dew point may climb causing condensation on the beams. The beam condensation sensor may detect this occurrence, and shut off the chilled water to the beam. As a result, the rooms could remain without cooling for extended periods making it difficult to cool them back down in a timely manner, for example, the next morning.

VAV can also be tied to occupancy or CO2 sensors, for example, to allow the airflow to be reduced to the chilled beams when there is only partial occupancy—for example, a teacher in a room grading papers. In this case, the lights would still be on adding sensible load to the space and there can still be a significant sensible solar load to the classroom on a sunny day. At times like this, there may not be adequate cooling capacity delivered by the beams. When the airflow is reduced to the chilled beam, the induction air (air passed through the coil) is significantly reduced. At the same time, the cooling provided by the primary air is also reduced. If the room gets too hot, there is no way for the prior art design to respond. It would therefore be highly beneficial to have a system for controlling chilled-beam systems that can better respond to the challenges associated with a VAV application; being able to actively avoid beam condensation if the dehumidification provided by the primary air is inadequate and providing a boost to cooling capacity from the beams at the low primary airflow conditions.

Since, as previously discussed, the state-of-the-art chilled-beam system design uses supply chilled water having a temperature of approximately 58 degrees F., and since the water temperature leaving the beams is generally in the range of 65 degrees F., the delta T across the system is approximately 7 degrees F. A well designed system may use a variable speed primary water pump to respond to part load cooling and heating conditions while maintaining a constant pressure within the supply water distribution pipe network. As a result, as the load on the chilled beams is reduced, the two-way valves are cycled taking less water from the supply loop, and the pump reduces flow to save energy. Although chilled water flow is reduced, the temperature differential (delta T) across the secondary heat exchanger or chiller remains low (e.g., only about 7 degrees) which impacts negatively on chiller performance. As a result, it would be highly beneficial to have a system for controlling chilled-beam systems that can be operated to provide a greater delta T across the chiller or heat exchanger to increase chiller performance.

Moreover, the typical state-of-the-art chilled beam design system is independent from the DOAS/primary air system that delivers primary airflow to the beam system. The temperature sensor assigned to each zone monitors the sensible cooling needs of the zone but provides no feedback to the DOAS to provide guidance as to the dew point appropriate to satisfy the space latent load. Nor does it allow for optimization of the overall system. This prior art example relies solely on the load calculations made regarding space latent loads, perhaps adjusting the supply air dew point from the DOAS/primary air system based on outdoor air dew point or the relative humidity of the air returning to the DOAS/primary air system from the mixture of all zones. For the many reasons discussed up to this point regarding limitations of the state-of-the-art chilled-beam system design, it would be highly beneficial to allow for active communication of the real-time conditions in each zone (e.g., zone air temperature and humidity, supply water temperature, occupancy, etc.) to the DOAS/primary air system (and or building BAS) so that more effective system performance and condensation control strategies could be implemented.

Other needs or potential for benefit or improvement may also be described herein or known in the HVAC or control industries. Room for improvement exists over the prior art in these and other areas that may be apparent to a person of ordinary skill in the art having studied this document.

Figure 1:
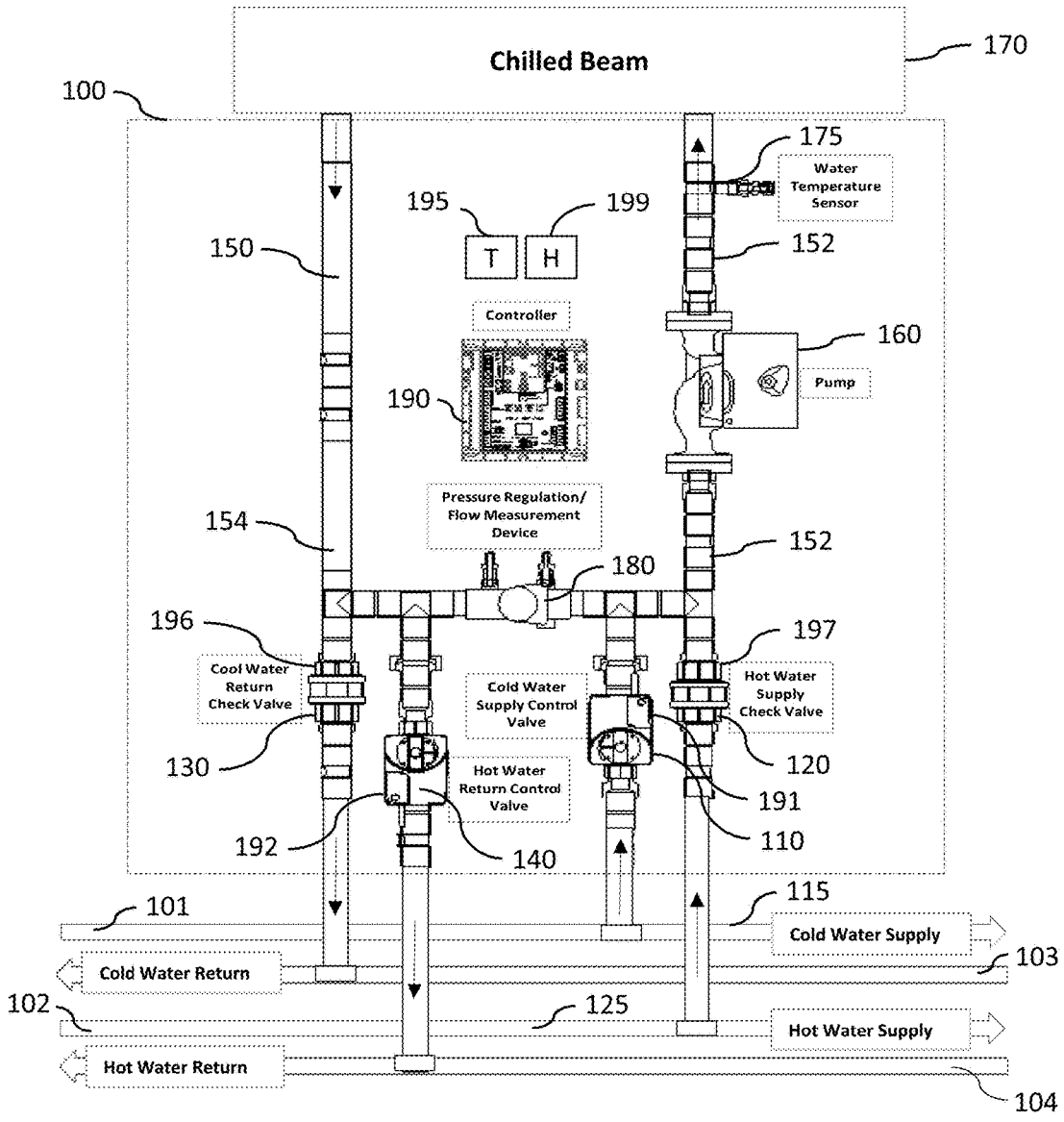
FIG. 1 is a diagram illustrating various components of an example of a chilled-beam zone pump module.

These drawings illustrate, among other things, examples of certain components and aspects of particular embodiments of the invention. Other embodiments may differ. Various embodiments may include some or all of the components or aspects shown in the drawings, described in the specification, shown or described in other documents that are incorporated by reference, known in the art, or a combination thereof, as examples. The drawings herein are of a schematic nature and are not necessarily drawn to scale. Further, embodiments of the invention can include a sub-combination of the components shown in any particular drawing, components from multiple drawings, or both.

SUMMARY OF CERTAIN EXAMPLES OF EMBODIMENTS

This invention provides, among other things, various controllable chilled-beam zone pump modules for controlling at least one zone of a chilled-beam heating and air conditioning system; certain multiple-zone chilled beam air conditioning systems for cooling a multiple-zone space; and particular methods of controlling at least one chilled beam in a zone of a multi-zone air conditioning system, for example, to reduce energy consumption, increase capacity, or both. Various embodiments provide, for example, as an object or benefit, that they partially or fully address or satisfy one or more of the needs, potential areas for benefit, or opportunities for improvement described herein, or known in the art, as examples.

Certain embodiments provide, for example, as objects or benefits, for instance, that they improve the performance of active or passive chilled-beam system designs. Different embodiments simplify the design and installation of chilled-beam systems, reduce the installed cost of the technology, increase energy efficiency, or a combination thereof, as examples. A number of embodiments allow a conventional chilled or hot water system to be used for the primary cooling and heating water loops serving a beam network by mixing only the quantity of loop water needed with additional beam bypass water to deliver a moderate water temperature to the chilled beams so they will function properly. In certain embodiments, this solves one of the major barriers to market acceptance, namely, the requirement for two separate water loops, one for the beams and a second colder/hotter loop for the primary air handling unit serving the beams.

Further, in a number of embodiments, by allowing much-colder loop water for beam cooling and hotter loop water for beam heating, the main loop pipe size can be reduced, substantially cutting the installation cost and potentially offsetting added costs. In particular embodiments, a one-pipe design is used for heating and cooling (one pipe for each), in which case the length of the main distribution water piping can be cut in half. This addresses another major barrier to market acceptance, in certain embodiments, namely, the high cost of the distribution piping. Further, in various embodiments, all passes of the coil in the chilled beam are used for either cooling or heating, thereby increasing the output capacity when compared to more conventional designs which allocate some passes to heating and others to cooling. This allows for shorter or fewer beams to be used in many cases. Moreover, in certain embodiments, an active condensation control system continues to provide cooling to the zone while simultaneously preventing condensation on the beam surface, yet another major barrier to acceptance of the technology.

Moreover, various embodiments provide a significant increase in the temperature differential between the supply water and the return water to the chiller, enhancing chiller efficiency. Further, various embodiments provide local control of the water flow to the chilled beams and allow the option for variable flow control, which can reduce energy consumption while providing many system performance enhancements, for example, active condensation control, heating and cooling capacity boost, and improved capacity modulation, especially during times where the beam primary airflow is reduced (e.g., VAV or unoccupied periods). Furthermore, a number of embodiments greatly simplify the effort required and increase the effectiveness of the water flow balancing process within individual zones, provide greater flexibility to compensate for errors in initial load calculations or future cooling or heating capacity requirements in an individual zone, or both. Finally, particular embodiments allows for effective communication between the DOAS/primary air handling system serving the chilled beams and the individual zones. The individual zone temperature, relative humidity level, dew point, beam water temperature and other information, in a number of embodiments, may allow both the beam system and the DOAS to be improved or optimized for energy efficiency, VAV operation, condensation control, or a combination thereof, as examples.

Specific embodiments of the invention provide various controllable chilled-beam zone pump modules, for example, for controlling at least one zone of a chilled-beam heating and air conditioning system. Such a module can include, for example, a conduit, a zone pump, and various valves. The conduit can be used for passing water therethrough and through at least one chilled beam, and for recirculating the water therein for controlling temperature of the at least one chilled beam. Further, the conduit can include a supply portion supplying the water to the at least one chilled beam and a return portion returning the water from the at least one chilled beam. Even further, the return portion can be connected to the supply portion for recirculating the water in the conduit and in the at least one chilled beam for controlling the temperature of the at least one chilled beam. Further still, the zone pump can be mounted in the conduit where the zone pump circulates the water through the conduit and through the at least one chilled beam and recirculates the water in the conduit and in the at least one chilled beam for controlling the temperature of the at least one chilled beam. In different embodiments, the zone pump can be mounted in the supply portion of the conduit or in the return portion of the conduit. Still further, the valves can include a chilled-water inlet valve for passing chilled water from a chilled-water distribution system to the conduit, a warm-water inlet valve for passing warm water from a warm-water distribution system to the conduit, a chilled-water outlet valve for passing water from the conduit to the chilled-water distribution system, and a warm-water outlet valve for passing water from the conduit to the warm-water distribution system. Even further still, in various embodiments, at least one of the chilled-water inlet valve or the chilled-water outlet valve is a first control valve, at least one of the warm-water inlet valve or the warm-water outlet valve is a second control valve, the chilled-water inlet valve is connected to the supply portion of the conduit, the chilled-water outlet valve is connected to the return portion of the conduit, the warm-water inlet valve is connected to the supply portion of the conduit, and the warm-water outlet valve is connected to the return portion of the conduit.

Moreover, in some such embodiments, one of the first control valve or the second control valve is connected to the supply portion of the conduit and the other of the first control valve or the second control valve is connected to the return portion of the conduit. Further, in some embodiments, one of the chilled-water inlet valve or the chilled-water outlet valve is a first check valve, and one of the warm-water inlet valve or the warm-water outlet valve is a second check valve. Even further, in certain embodiments, one of the chilled-water inlet valve or the warm-water inlet valve is a first check valve, and one of the chilled-water outlet valve or the warm-water outlet valve is a second check valve. Further still, some embodiments further include a first temperature sensor measuring temperature of the water delivered to the at least one chilled beam and a digital controller, for example, specifically configured to control at least the first control valve and the second control valve based upon input from the first temperature sensor, for instance, to control temperature of the water delivered to the at least one chilled beam. Still further, in some embodiments, the digital controller is further specifically configured to control at least the first control valve and the second control valve based upon input from a second temperature sensor, zone temperature sensor, or thermostat, for example, located within the at least one zone, to control temperature of the at least one zone.

In some embodiments, the digital controller is further specifically configured to control at least the first control valve based upon input from a humidistat, for instance, located within the at least one zone, for example, to control the temperature of the at least one chilled beam, for instance, to keep the temperature of the at least one chilled beam above a present dew point temperature within the at least one zone. Moreover, in particular embodiments, the zone pump is a multiple-speed pump and the digital controller is further specifically configured to control speed of the zone pump based at least upon input from the zone temperature sensor or thermostat. Furthermore, in certain embodiments, the module can include a pressure regulation device connecting the supply portion of the conduit to the return portion of the conduit for recirculating the water in the conduit and in the at least one chilled beam and for restricting flow of the water from the return portion to the supply portion, for example, to provide for flow of the water through the chilled-water inlet valve and the chilled-water outlet valve or through the warm-water inlet valve and the warm-water outlet valve, for instance, for controlling temperature of the at least one chilled beam. In some embodiments, for example, the pressure regulation device is a circuit setter. Further, in particular embodiments, each zone of the heating and air conditioning system has only one zone pump (e.g., and no other water pump).

Still other specific embodiments of the invention provide various multiple-zone chilled beam air conditioning systems, for example, for cooling a multiple-zone space. In a number of embodiments, such a multiple-zone chilled beam air conditioning system can include, for example, a chilled-water distribution system and multiple zones, each zone including certain equipment or features. The chilled-water distribution system can include, for example, at least one chilled water circulation pump, at least one chiller, and a chilled water loop, and the chilled water circulation pump can circulate chilled water through the at least one chiller and through the chilled water loop. Further, the multiple zones, can each include, for example, at least one chilled beam, a conduit, a zone pump, a zone controller, an inlet, an outlet, a control valve, and various sensors. The conduit can be used for passing water therethrough and through the at least one chilled beam, and for recirculating the water therein for controlling temperature of the at least one chilled beam. Further, the conduit can include a supply portion for supplying the water to the at least one chilled beam and a return portion for returning water from the at least one chilled beam, and the return portion can be connected to the supply portion for recirculating the water in the conduit and in the at least one chilled beam, for example, for controlling the temperature of the at least one chilled beam. Even further, the zone pump can be mounted in the conduit for passing the water through the conduit and through the at least one chilled beam, and for recirculating the water in the conduit and in the at least one chilled beam, for example, for controlling the temperature of the at least one chilled beam. Still further, the zone pump can be mounted in the supply portion of the conduit or in the return portion of the conduit.

Further still, the inlet and outlet mentioned can include a chilled-water inlet for passing water from the chilled water loop to the conduit, and a chilled-water outlet for passing water from the conduit to the chilled water loop, and the control valve can be a chilled water control valve for passing chilled water, for example, between the chilled water loop and the conduit. Even further still, the controller can be a digital controller, for example, specifically configured to control at least the chilled water control valve based upon input from the water temperature sensor, for instance, to control temperature of the water delivered to the at least one chilled beam. Moreover, the sensors can include a water temperature sensor, a zone or space temperature sensor or thermostat, for instance, located within the zone, for example, to control temperature of the zone, and a zone humidistat, for instance, located within the zone or to measure humidity within the zone. In a number of embodiments, the digital controller is further specifically configured to control at least the chilled water control valve in the zone based upon input from the space temperature sensor or thermostat, and to control at least the chilled water control valve serving the zone based upon input from the zone humidistat, for example, to control the temperature of the at least one chilled beam to keep the temperature of the at least one chilled beam above a present dew point temperature within the zone. In various embodiments, the chilled water control valve is located in the chilled-water inlet or in the chilled-water outlet, the chilled-water inlet is connected to the supply portion of the conduit and the chilled-water outlet is connected to the return portion of the conduit, and each zone has only one zone pump, for instance, and no other water pump.

In some such embodiments, the multiple-zone chilled beam air conditioning system can further include a warm-water distribution system that can include, for example, at least one warm water circulation pump, at least one water heater, and a warm water loop. Further, the warm water circulation pump can circulate warm water through the at least one water heater and through the warm water loop. In a number of embodiments, each zone can further include a warm-water inlet for passing water from the warm water loop to the conduit, a warm-water outlet for passing water from the conduit to the warm water loop, and a warm water control valve for passing warm water between the warm water loop and the conduit. In a number of such embodiments, the warm water control valve is located in the warm-water inlet or in the warm-water outlet, the warm-water inlet is connected to the supply portion of the conduit, and the warm-water outlet is connected to the return portion of the conduit, for example.

In various such embodiments, in each zone, one of the chilled-water control valve or the warm-water control valve is connected to the supply portion of the conduit and the other of the chilled-water control valve or the warm-water control valve is connected to the return portion of the conduit. Moreover, in a number of embodiments, in each zone, one of the warm-water inlet or the warm-water outlet includes a check valve, one of the chilled-water inlet or the chilled-water outlet includes a check valve, one of the chilled-water inlet or the warm-water inlet includes a check valve, and one of the chilled-water outlet or the warm-water outlet includes a check valve. Further, in particular embodiments, for example, in each of multiple zones, the zone pump is a multiple-speed zone pump and the digital controller is further specifically configured to control speed of the zone pump based at least upon input from the zone or space temperature sensor or thermostat located within the at least one zone to control temperature of the at least one zone. Even further, in certain embodiments, each zone can further include a device connecting the supply portion of the conduit to the return portion of the conduit for recirculating the water in the conduit and in the at least one chilled beam and for restricting flow of the water from the return portion to the supply portion, for example, to provide for flow of the water through the chilled-water inlet and the chilled-water outlet for controlling temperature of the at least one chilled beam.

Further, in a number of embodiments, at least one chilled beam in each zone is an active chilled beam, and the multiple-zone chilled beam air conditioning system further includes an outside air delivery system delivering outside air to the at least one chilled beam in each zone. In particular embodiments, for example, the outside air delivery system can include a central controller, the outside air delivery system delivers dehumidified air to each zone, and the central controller is specifically configured to use readings from each zone humidistat to control how much humidity is removed from the outside air in the outside air delivery system delivering outside air to the at least one chilled beam in each zone. Further still, in certain embodiments, the chilled-water distribution system can include only one chilled water loop rather than a chilled water supply loop and a separate chilled water return loop.

Further, other specific embodiments of the invention provide various methods, for example, of controlling at least one chilled beam in a zone of a multi-zone air conditioning system, for instance, to reduce energy consumption, increase capacity, or both. In a number of such embodiments, the at least one chilled beam is cooled with chilled water. Such a method can include, for example, at least the acts of operating a zone pump, measuring space temperature within the zone, measuring humidity or dew point within the zone, measuring temperature of water entering the at least one chilled beam, and automatically modulating at least one chilled-water control valve. The act of operating the zone pump can include, in a number of embodiments, operating a zone pump serving the zone that both recirculates water through the at least one chilled beam and circulates chilled water from a chilled-water distribution system into the at least one chilled beam. Further, the act of automatically modulating at least one chilled-water control valve can include regulating how much water passing through the zone pump is recirculated through the at least one chilled beam and how much of the water passing through the zone pump is circulated from the chilled water distribution system. Even further, the act of automatically modulating the at least one chilled-water control valve can include maintaining the temperature of the water entering the at least one chilled beam at least a predetermined temperature differential above the dew point within the zone.

In addition, various other embodiments of the invention are also described herein, and other benefits of certain embodiments may be apparent to a person of ordinary skill in the art.

DETAILED DESCRIPTION OF EXAMPLES OF EMBODIMENTS

FIG. 1 illustrates an example of a controllable chilled-beam zone pump module for controlling at least one zone of a chilled-beam heating and air conditioning system, controllable chilled-beam zone pump module 100. In this particular embodiment, controllable chilled-beam zone pump module 100 includes chilled-water inlet valve 110, warm-water inlet valve 120, chilled-water outlet valve 130, warm-water outlet valve 140, conduit 150, and zone pump 160 (e.g., constant speed, step controlled or variable flow). Other embodiments may include some of these components, but not others, and various embodiments may include additional components as well. Further, a number of embodiments require particular features, functions, or definitive functional capability for the required components. As used herein, a "conduit" is an enclosed passageway. A conduit can include, for example, piping, fittings, tubing, valve bodies, or a combination thereof, for instance. In the embodiment shown, conduit 150 passes water therethrough and through at least one chilled beam (e.g., 170), and recirculates the water therein controlling the temperature of the (e.g., at least one) chilled beam (e.g., 170). In the embodiment illustrated, chilled-beam zone pump module 100 serves one chilled beam 170, but in other embodiments, one chilled-beam zone pump module may supply water to 2, 3, 4, 5, 6, 7, 8, 9, 10, 12, 15, or more chilled beams, as examples, for instance, in one room or one zone of a building.

In the embodiment shown, conduit 150 includes supply portion 152 supplying the water to the (e.g., at least one) chilled beam (e.g., 170) and return portion 154 returning water from the (e.g., at least one) chilled beam (e.g., 170). Further, in this embodiment, return portion 154 is connected to supply portion 152 at device 180 for recirculating the water in conduit 150 and in the (e.g., at least one) chilled beam (e.g., 170) for controlling the temperature of the (e.g., at least one) chilled beam (e.g., 170). Further still, in this embodiment, zone pump 160 is mounted in conduit 150 for circulating the water through conduit 150 and through the (e.g., at least one) chilled beam (e.g., 170), and for recirculating the water in conduit 150 and in the (e.g., at least one) chilled beam (e.g., 170) for controlling the temperature of the (e.g., at least one) chilled beam (e.g., 170). In different embodiments, the zone pump (e.g., 160) can be mounted in the supply portion (e.g., 152) of the conduit (e.g., 150) or in the return portion (e.g., 154) of the conduit (e.g., 150), as examples. In the embodiment illustrated, zone pump 160 is mounted in supply portion 152 of conduit 150, but in other embodiments, the zone pump may be mounted in another location, for instance, in the return portion (e.g., 154). Further, in a number of embodiments, including in the embodiment illustrated, each zone of the heating and air conditioning system has only one zone pump (e.g., 160) and no other water pump.

In the embodiment shown, chilled-water inlet valve 110 is connected to chilled-water supply line 101 for circulating or passing chilled water from chilled-water distribution system 115 to conduit 150. In this embodiment, chilled-water distribution system 115 includes chilled-water supply line 101 and chilled-water return line 103, among other components not shown in FIG. 1. Similarly, in this particular embodiment, warm-water inlet valve 120 is connected to warm-water supply line 102 for circulating or passing warm water from warm-water distribution system 125 to conduit 150. In this embodiment, warm-water distribution system 125 includes warm-water supply line 102 and warm-water return line 104, among other components not shown in FIG. 1. Further, in this embodiment, chilled-water outlet valve 130 is connected to chilled-water return line 103 for passing water from conduit 150 to chilled-water distribution system 115, and warm-water outlet valve 140 is connected to warm-water return line 104 for passing water from conduit 150 to warm-water distribution system 125.

In a number of embodiments, at least one of the chilled-water inlet valve (e.g., 110) or the chilled-water outlet valve (e.g., 130) is a first control valve (e.g., 191), at least one of the warm-water inlet valve (e.g., 120) or the warm-water outlet valve (e.g., 140) is a second control valve (e.g., 192), or both. In the particular embodiment illustrated, for instance, chilled-water inlet valve 110 is first control valve 191, and warm-water outlet valve 140 is second control valve 192. In contrast, in other embodiments, the chilled-water outlet valve (e.g., 130) is the first control valve (e.g., 191), and the warm-water inlet valve (e.g., 120) is the second control valve (e.g., 192). Other embodiments can differ. As used herein, a "control valve" (e.g., 191 or 192) is a valve that is equipped or configured specifically to be operated automatically under the control of a controller, as opposed to a valve that is configured for manual operation but could be operated automatically if a power actuator were attached to the valve. As used herein, a "control valve" is a valve that includes an actuator (i.e., a power actuator) other than a manual actuator. Even further, as used herein, a "control valve" is a valve that is operated automatically, for instance, by a controller. Moreover, as used herein, a "manual actuator" is an actuator that is configured to be operated manually by a person at the valve. Examples of manual operators include handles and elongated or regular polygonal fittings for attachment of a handle or tool.

Further, in the embodiment illustrated, for instance, chilled-water inlet valve 110 is connected to supply portion 152 of conduit 150 and chilled-water outlet valve 130 is connected to return portion 154 of conduit 150. Similarly, in the embodiment illustrated, for instance, warm-water inlet valve 120 is connected to supply portion 152 of conduit 150 and warm-water outlet valve 140 is connected to return portion 154 of conduit 150. As used herein, a valve being "connected" to a supply portion of a conduit within a pump module means that water that passes through the valve to the conduit within the module reaches the supply portion of the conduit before reaching the return portion of the conduit. Similarly, as used herein, a valve being "connected" to a return portion of a conduit within a pump module means that water that passes through the valve from the conduit would have passed through the return portion of the conduit more recently than through the supply portion of the conduit. Moreover, in a number of embodiments, one of the first control valve (e.g., 191) or the second control valve (e.g., 192) is connected to the supply portion (e.g., 152) of the conduit (e.g., 150) and the other of the first control valve (e.g., 191) or the second control valve (e.g., 192) is connected to the return portion (e.g., 154) of the conduit (e.g., 150). In the embodiment illustrated, for example, first control valve 191 is connected to supply portion 152 of conduit 150 and (the other) second control valve 192 is connected to return portion 154 of conduit 150. In contrast, in other embodiments, as another example, the first control valve (e.g., 191) is connected to the return portion (e.g., 154) of the conduit (e.g., 150) and (the other) second control valve (e.g., 192) is connected to the supply portion (e.g., 152) of the conduit (e.g., 150). Still other embodiments may differ.

In a number of embodiments, at least one of the chilled-water inlet valve (e.g., 110), the chilled-water outlet valve (e.g., 130), the warm-water inlet valve (e.g., 120), or the warm-water outlet valve (e.g., 140) is a two-way control valve. Moreover, in particular embodiments, the first control valve (e.g., 191) is a two-way control valve and the second control valve (e.g., 192) is a two-way control valve. In the particular embodiment illustrated, chilled-water inlet valve 110 and warm-water outlet valve 140 are two-way control valves. Moreover, in this embodiment, first control valve 191 is a two-way control valve and second control valve 192 is a two-way control valve.

Further, in a number of embodiments, one of the chilled-water inlet valve (e.g., 110) or the chilled-water outlet valve (e.g., 130) is a first check valve, one of the warm-water inlet valve (e.g., 120) or the warm-water outlet valve (e.g., 140) is a second check valve, or both. Use of check valves, in various embodiments, can reduce or eliminate the need for additional control valves, for example. Even further, in some embodiments, one of the chilled-water inlet valve (e.g., 110) or the warm-water inlet valve (e.g., 120) is a first check valve, and one of the chilled-water outlet valve (e.g., 130) or the warm-water outlet valve (e.g., 140) is a second check valve. In this context, the "first" check valve in this last sentence can be, but is not necessarily, the same check valve as the "first" check valve in the previous sentence and the "second" check valve in this last sentence can be, but is not necessarily, the same check valve as the "second" check valve in the previous sentence. In the embodiment illustrated in FIG. 1, however, the first check valve is the same in both of the above sentences and the second check valve is the same in both of the above sentences. Namely, chilled-water outlet valve 130 is first check valve 196, and warm-water inlet valve 120 is second check valve 197. In other embodiments, the chilled-water inlet valve (e.g., 110) and the warm-water outlet valve (e.g., 140) are the first and second check valves, as another example. Other embodiments may differ. For example, other embodiments, may use control valves instead of check valves. Using control valves instead of check valves can reduce or eliminate the need for other valves or devices (e.g., reducing the restriction required from device 180), in some embodiments, can reduce the amount of pump energy required, or both, as examples.

For example, in other embodiments, the illustrated check valves (e.g., 196 and 197) can be replaced with two-position restriction valves or other similar devices, but the check valves have the advantage of not requiring additional control signals or actuators. Likewise, the combination control valve and check valve can be replaced by a single three-way mixing valve, however, particular arrangements of this type can result in less than ideal control and can create problems with achieving cool-enough chilled water to the chilled beams at the end of a one-pipe system design. In other embodiments, the control valves can be replaced with three-way valves while the check valves are maintained. Particular alternative embodiments are described further herein.

In a number of embodiments, it may be beneficial to choose check/control valves that have a low pressure loss when opened and for the check valves, a low cracking pressure or pressure differential required across the valve for it to open. The check valves may also be selected, in various embodiments, to be tight sealing when closed and to operate reliably. The modulating control valves (e.g., 191 and 192) may be selected, in a number of embodiments, to seal tightly when closed and to modulate evenly through the range to 100% open. The CV or pressure loss characteristics for these valves, in a number of embodiments, may be as low as practicable while still providing good modulation. When the heating water flow is selected to be significantly less that the cooling water flow, a smaller valve or similar valve fitted with an increased restriction (higher CV) can be used to provide better control modulation. An actuated ball valve from Belimo having a model number B217B+TR24-SR-TUS was found to be effective for this purpose in certain embodiments.

Various embodiments include a first or water temperature sensor for measuring temperature, for example, of the water delivered to the (e.g., at least one) chilled beam (e.g., 170). In the embodiment illustrated, for example, controllable chilled-beam zone pump module 100 includes water temperature sensor 175 mounted in supply portion 152 of conduit 150. In other embodiments, a temperature sensor may be mounted at a chilled beam (e.g., 170), for instance, at the inlet of the chilled beam, as another example. Moreover, in different embodiments, temperature sensor 175 may measure water temperature directly within conduit 150, or may measure the temperature of conduit 150, for example, at the outside surface of conduit 150. As used herein, a "water temperature sensor" or a "temperature sensor measuring temperature of the water delivered to" one or more chilled beams includes temperature sensors that measure water temperature directly and temperature sensors that measure water temperature indirectly (e.g., by measuring conduit temperature or chilled beam temperature). Further, a number of embodiments include a digital controller, for instance, specifically configured to control (e.g., at least) the first control valve (e.g., 191), the second control valve (e.g., 192), or both, based upon input from the water temperature sensor (e.g., 175), for example, to control temperature of the water delivered to the (e.g., at least one) chilled beam (e.g., 175). In the embodiment illustrated, for example, controllable chilled-beam zone pump module 100 includes digital controller 190, which is specifically configured (e.g., programmed) to control first control valve 191 and second control valve 192 based upon input from the water temperature sensor 175, to control temperature of water delivered to the (e.g., at least one) chilled beam 175.

Controller 190 can be a computer or can include a microprocessor, for example. In some embodiments, controller 190 can include a user interface, such as a keypad or keyboard, a display, or both. Other controllers described herein may be similar. Further, as used herein, a controller being "specifically configured" to perform a particular function means that the controller contains programming instructions, that, if executed, perform the particular function or cause other components to perform the particular function. A controller being capable of being so programmed is insufficient, as used herein, if the programming instructions are lacking. In some embodiments, controller 190 provides signals to the control valves (e.g., 191 and 192), pump (e.g., 160), monitor alarms, or a combination thereof. In some embodiments, controller 190 transfers data to a building automation system or dedicated outdoor air system serving the chilled beams. In various embodiments, the controller (e.g., 190, receives data from the supply water temperature sensor (e.g., 175), a return water temperature sensor, feedback from the pump (e.g., 160), space sensors (e.g., 195, 199, or both), or a combination thereof. The space sensors include, in this particular embodiment, a zone temperature sensor (e.g., 195), a space RH sensor (e.g., 199) and, in certain embodiments, can include an occupancy sensor (e.g., CO2 or motion). Other embodiments may have just some of these components, may have additional components, or both, as further examples.

Furthermore, in the embodiment illustrated, digital controller 190 is further specifically configured to control (e.g., at least) first control valve 191 and second control valve 192 based upon input from zone temperature sensor 195 which is located within, or senses temperature within, (or both) the (e.g., at least one) zone. Zone temperature sensor 195 may sense air temperature within the zone, for example, a representative air temperature or space temperature for the zone. Further, in a number of embodiments, digital controller 190 or zone temperature sensor 195 include a user interface through which a user can input a set point temperature. In various embodiments, digital controller 190 or zone temperature sensor 195, is a thermostat. Further, in certain embodiments, digital controller 190 and zone temperature sensor 195 are combined. Even further, in particular embodiments, digital controller 190 and zone temperature sensor 195, whether separate components or combined, together form a thermostat. In the embodiment shown, digital controller 190 is configured to control first control valve 191 and second control valve 192 based upon input from zone temperatures sensor 195 to control temperature of the (e.g., at least one) zone. Moreover, in the embodiment shown, zone pump 160 is a multiple-speed pump and digital controller 190 is further specifically configured to control speed of zone pump 160 based (e.g., at least) upon input from thermostat or zone temperature sensor 195. Further, in the embodiment illustrated, digital controller 190 is further specifically configured to control (e.g., at least) first control valve 191 based upon input from zone humidistat 199, for example, located within the (e.g., at least one) zone. In this particular embodiment, digital controller 190 is specifically configured to control first control valve 191 based upon input from humidistat 199 to control the temperature of the (e.g., at least one) chilled beam 170 to keep the temperature of the (e.g., at least one) chilled beam above a present dew point temperature within the (e.g., at least one) zone. In this embodiment, the present dew point temperature is measured or calculated using a signal from humidistat 199, for example. As used herein, a humidistat is an instrument that measures humidity, dew point, or a parameter that can be used to calculate humidity or dew point.

In some embodiments, a more advanced controller (e.g., 190) is used that can be custom programmed, field modifiable, and able to communicate data from each zone to both the central building automation system (BAS) as well as the DOAS delivering the primary airflow to the chilled beams, as another example. Such a controller may, for example, be able to communicate using one or more of the popular protocols, such as BACnet, Modbus, N2, LonWorks, HTTP, or a combination thereof, as examples. This more-sophisticated controller may allow for full beneficial use of the zone pump module, providing solutions to a number of the problems or limitations associated with the current state-of-the-art chilled beam designs as previously described. For example, such a controller (e.g., 190) may allow for active condensation prevention control, support variable airflow function during low or unoccupied periods, allow for full variable-flow pumping capability to optimize energy efficiency, provide a boost mode for extreme cooling and/or heating conditions, allow for direct communication between some or all zones and the DOAS (dedicated outdoor air systems) serving the beams with primary air, or a combination thereof, as examples.

Such a controller may, in some embodiments, receive information that can be processed and conveyed to the main BAS system. For example, pump information can be monitored, in certain embodiments, such as energy use, overloading or pump failure, or a combination thereof. Likewise, alarms for the individual spaces can also be sent, in particular embodiments, to warn if the desired room conditions are not being met, if conditions that might result in condensation are being observed, or if the desired supply water temperature to the beams cannot be achieved, as examples. Various controllers that are suitable for this purpose are available. A particularly flexible and highly functional controller for this purpose is manufactured by OEMCtrl with the model designation I/O Zone 583. This controller provides excellent communications capabilities, 5 digital and 3 analog outputs, and 8 inputs, and can be field accessed by a laptop computer or key pad. These options can provide capability to access space temperature and humidity, in some embodiments, along with occupancy status, supply water temperature, and room temperature set points from the BAS system, for instance. Various embodiments of controllers can provide outputs to the control valves, pump, VAV zone damper, and numerous other valuable status points of interest, for example.

Various types of water pumps (e.g., 160) can be used in different embodiments, for example, an inline pump. An installation that can be easily isolated and replaced may be used in a number of embodiments. In particular embodiments, the pump may provide a wide range of flow and pressure performance capabilities. For some embodiments of the zone pump module (e.g., 100), a constant speed pump or one that allows for manual adjustment of different pump speeds (flow switches) may be used, for example, similar to that produced by Grundfos model UPS-15-58. The size of the pump could be larger or smaller depending upon the flow requirements of a given project. In other embodiments of the zone pump module, a modified form of the Grundfos UPS-15 pump may be beneficial. In some embodiments, different pump speeds can be selected by the controller (e.g., 190) to match the water flow to the needs of the system for energy efficiency, or to provide other beneficial operating modes.

In certain embodiments of the zone pump module (e.g., 100), a fully adjustable variable speed pump is used, such as the Grundfos UPM2 GEO 15 or Magna GEO 32, both of which allow for the controller (e.g., 190) to change the speed of the pump, as needed, for example, for optimizing energy efficiency or for providing for additional beneficial operating modes. Various pumps are compact and can be interchanged with only modest changes in size to allow for a wide range of flow volumes and system pressures. The Grundfos UPM2 GEO and Magna GEO families may be beneficial when energy efficiency is desired, since they employ ECM (electronically commutated motor) pumps driven by a permanent magnet rotor and frequency inverter which utilizes far less energy than other traditional small motors.

Figure 2:
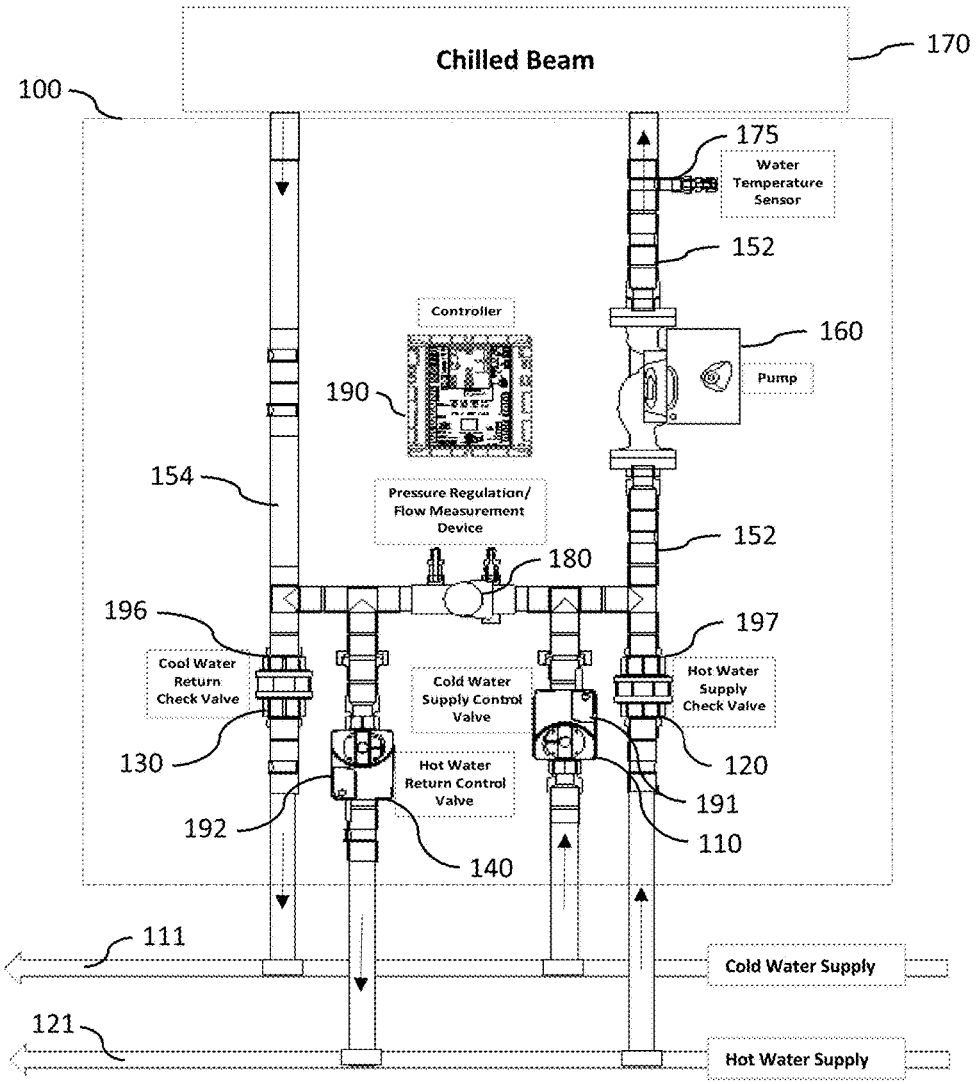
FIG. 2 is a diagram illustrating the chilled-beam zone pump module of FIG. 1 installed in a two-pipe chilled and hot water distribution system rather than a 4-pipe system.

In a number of embodiments, the zone pump module (e.g., 100) can be served by a stand-alone zone controller (e.g., 190). For example, in particular embodiments, the space temperature (e.g., at thermostat or zone temperature sensor 195) can be monitored (or manually set) to choose between heating and cooling, then the appropriate control valve (e.g., 191 or 192) can be modulated (e.g., by controller 190) to deliver the desired supply water temperature to the beams (e.g., 170). A multi-speed pump (e.g., 160) can be used with such a controller (e.g., 190), for example, to be operated at the intermediate speed during normal cooling operation, increased speed to enhance cooling output (e.g., when there is a need for more cooling output at extreme conditions) and low speed during heating mode or, in some embodiments, when cooling demand is light. In certain embodiments, set points are changed locally in the zone (e.g., by a user or occupant at thermostat or controller 190 or 195) and no remote communications or advance logic is used. Relatively low-cost stand-alone controllers are available to operate in this manner (e.g., as controller 190). One example is the VT735005 Digital Stand-Alone Thermostat produced by Viconics Electronics. In a number of embodiments, the controller (e.g., 190) is remote to the zone pump module (e.g., 100), and may communicate with the control valves (e.g., 191, 192, or both) and pump (e.g., 160) through cabling installed between the stand-alone controller (e.g., 190) and a terminal block in the zone pump module, for example. This approach may have a low cost, may allow for the cost savings provided by a single pipe cooling and/or heating distribution system (e.g., as shown in FIG. 2 described below), may avoid the need of a separate cooling/heating loop for the chilled beams and the DOAS, and may provide for significant pump energy savings during the heating mode, for example. Other embodiments, however, may differ.

Certain embodiments include a device (e.g., 180), for instance, a pressure regulation device, connecting the supply portion (e.g., 152) of the conduit (e.g., 150) to the return portion (e.g., 154) of the conduit (e.g., 150), for instance, for recirculating the water in the conduit (e.g., 150) and in the (e.g., at least one) chilled beam (e.g., 170) and for restricting flow of the water from the return portion (e.g., 154) to the supply portion (e.g., 152) to provide for circulation or flow of the water through the chilled-water inlet valve (e.g., 110) and the chilled-water outlet valve (e.g., 130), through the warm-water inlet valve (e.g., 120) and the warm-water outlet valve (e.g., 140), or both (e.g., at different times), for example, for controlling temperature of the (e.g., at least one) chilled beam (e.g., 170). In some embodiments, device 180 can provide a certain amount of restriction to flow therethrough, to provide pressure sufficient to cause flow through the control valve (e.g., 191 or 192), check valve (e.g., 196 or 197), or both, rather than having all of the flow from the zone pump recirculate through device 180. In different embodiments, device 180 can include an orifice, can include a flow meter, can be a circuit setter, can be an automatic pressure regulation device that maintains a substantially constant or constant pressure loss across the device as the flow through the device varies over a range of flows, or a combination thereof, as examples. As used herein, a "substantially constant pressure loss across a pressure regulation device as the flow through the pressure regulation device varies over a range of flows" means that within the range, the pressure increases by no more than a factor of two when the flow increases by a factor of two. Further, as used herein, a "constant pressure loss across a pressure regulation device as the flow through the pressure regulation device varies over a range of flows" means that within the range, the pressure increases by no more than a factor of two when the flow increases by a factor of three. Some embodiments provide a constant pressure, however, that is even more constant, for example, where, within the range, the pressure increases by no more than a factor of two when the flow increases by a factor of four.

A number of embodiments include a pressure regulation device (e.g., 180) that, in particular embodiments, doubles as a flow measurement station. In various embodiments, the position and sizing of the pressure regulation device (e.g., that may double as a flow measurement station) may be worthy of some attention. In the embodiment illustrated in FIG. 1, this component (e.g., device 180) serves the function of providing the pressure required to cause the return water (e.g., in conduit portion 154) to leave the zone pump module (e.g., 100) and for the supply water (e.g., from cold water supply 101 or hot water supply 102) to enter the zone pump module, to be delivered to the chilled beam(s) (e.g., 170). Some level of testing may be appropriate to optimize the sizing of this device (e.g., 180), the control valves (e.g., 191 and 192), and the pipe and fitting dimensions (e.g., of conduit 150) to ensure both proper and efficient operation. This (e.g., pressure regulation) device (e.g., 180) may be sized, in various embodiments, such that the loss across it (absolute pressure difference) at the minimum operational flow rate through the device, is at least slightly greater than the higher of the "cracking pressure" of the two check valves (e.g., 196 and 197) and the pressure loss across the two control valves (e.g., 191 and 192) when fully open and passing the maximum design flow rates, for example. In certain embodiments, it may be beneficial to utilize check valves with a low cracking pressure, yet that also reliably close to form an adequately tight seal. Likewise, it may beneficial to select control valves and associated fittings with a low pressure loss while still offering the desired flow control characteristics. A low cracking pressure and control valve pressure loss allows for a low pre-set restriction at the (e.g., pressure regulation) device (e.g., 180) at low recirculation/bypass flow conditions which, in turn, may result in a corresponding reduction in pump (e.g., 160) energy consumption at high recirculation/bypass flow conditions, for instance.

In certain embodiments, an automatic pressure regulation device (e.g., 180) may provide desired energy efficiency, for instance. An example is a modulating valve driven by a transducer monitoring the pressure difference across the valve. Other examples include other types of devices that maintain a constant or substantially constant fixed pressure loss, for instance, as the flow across it is modulated. For reasons of cost and simplicity, however, the (e.g., pressure regulation) device (e.g., 180) for a number of embodiments can be a traditional circuit setter, similar to that manufactured by Bell and Gossett, for instance, model number CB-1S. This device is both cost effective and dual purpose (providing pressure regulation and flow measurement). Also, most installing contractors are familiar with reading and adjusting this type of device. Knowing the specified zone water flow required from the zone pump module, this device may be adjusted during startup in accordance with predetermined installation instructions provided for the zone pump module, for example. In some embodiments, the (e.g., pressure regulation) device (e.g., 180) or circuit setter, for instance, can be provided with factory settings, with no need for further adjustment in the field, as another example.

An advantage provided by certain embodiments of the zone pump module (e.g., 100) with the integrated pressure regulating circuit setter (e.g., as device 180) is that these embodiments provide an effective way to measure and adjust the water flow delivered by the pump (e.g., 160) to the beams (e.g., 170). This feature may simplify the beam water balancing of the flow within each individual zone. By closing the control valves (e.g., 191 and 192) and operating the pump (e.g., 160), the flow through the zone pump module may be measured across the circuit setter (e.g., device 180). As the pressure loss across the circuit setter is compared to the flow characterization curve at a given index setting, the appropriate pump setting (in multiple-speed embodiments) can be chosen or the appropriate 0-10 volt signal (in variable-flow embodiments) can be determined or verified to deliver the desired water flow to the beams. If the pump used is a single speed pump, the circuit setter may be adjusted to add the desired pressure loss to obtain the approximate flow desired (the more traditional use of the circuit setter), as another example. In a number of embodiments, the final circuit setter index setting used in combination with a pump speed adjustment determines or limits the flow through the zone pump module at design conditions. This final index setting may accommodate the flow from the pump to the beams and may provide that at times of minimum flow through the pressure regulation device, enough restriction exists to overcome the cracking pressure of the check valves and control valve losses to allow chilled or hot water to enter the zone pump module allowing the beams to function as designed.

Correctly sizing and adjusting the (e.g., pressure regulation) device (e.g., 180) is not necessarily a simple process, in many embodiments, and improper adjustment can render the system non-functional in certain embodiments. For example, if the pressure loss across the pressure regulation device (e.g., 180) is not adequate to overcome the cracking pressure of the check valves (e.g., 196 and 197 in FIG. 1) at the minimal flow conditions across the (e.g., pressure regulation) device (e.g., 180), no cooling will be provided by the beams (for example) since no chilled water will enter the zone pump module and all water moved by the pump will be recirculated/bypass water. Likewise, if the loss across the (e.g., pressure regulation) device (e.g., 180) is too low, in this embodiment, enough water flow cannot be pulled through the wide opened control valves (e.g., 191 or 192) to produce the required beam supply water temperature when a two pipe approach (e.g., as shown in FIG. 2 described below) is used and the end of the loop supply water temperatures approach that desired by the beams (e.g., very little bypass flow across the pressure regulation device). It may be advisable, in some embodiments, that the setting of the pressure regulation device (e.g., 180) be checked at the minimum flow conditions through the device to create an adequate pressure loss to ensure proper system operation at all operating conditions. This minimum flow index setting may then also be analyzed at the maximum flow (recirculation/bypass) through the device (e.g., 180), in a number of embodiments, to ensure that the resultant increase in pressure does not prove too limiting to the flow through the pump to the chilled-beam system.

Knowing what the minimum and maximum flows through the (e.g., pressure regulation) device (e.g., 180) are, and when they occur, can be complicated without a thorough understanding of the zone pump module system dynamics. It depends on various factors including the pump type used (variable or constant flow), the type of distribution used (4 pipe or 2 pipe), whether the zone pump module initial heating water flow rates are designed to be less than the initial cooling water flows, and what hot/cold supply water loop temperatures are being maintained at the beginning and end of the loops, as examples. Algorithms or product selection software may be used, in some embodiments, to provide the appropriate index setting for the (e.g., pressure regulation) device (e.g., 180). Once know, this setting may be implemented at the site.

In various embodiments, a zone pump module (e.g., 100 shown in FIG. 1) connects the chilled water control valve (e.g., 191) to the chilled water supply loop (e.g., 101) delivering water at a chilled water temperature that may vary over a rather wide range (e.g., 42 degrees F. to 60 degrees F.). The chilled water pulled from the loop (e.g., 101) by the pump (e.g., 160), in this particular embodiment, mixes with a portion of the return water (e.g., in return portion 154 of conduit 150) leaving the chilled beams (e.g., 170) after leaving the (e.g., pressure regulation) device (e.g., 180). The chilled water control valve (e.g., 191), in this embodiment, is modulated (e.g., by controller 190) to allow for the introduction of the amount of chilled water needed to achieve the desired chilled beam supply water temperature called for by the controller (e.g., 190) and measured at the supply cooling water temperature sensor (e.g., 175). The modulating chilled water control valve (e.g., 191) inlet water is balanced, in this embodiment, by discharging a similar volume of return water into the main cooling return water loop (e.g., 103) through the chilled water check valve (e.g., 196), allowing the replacement incoming chilled water to enter the system.

Likewise, in a heating mode configuration, the zone pump module (e.g., 100) connects the hot water check valve (e.g., 197) to the hot water supply loop (e.g., 102) delivering water at a hot water temperature that may very over a fairly wide range (e.g., 110 degrees F. to 160 degrees F.). The hot water pulled from the loop (e.g., 102) by the pump (e.g., 160), in this embodiment, mixes with a portion of the return water (e.g., in return portion 154 of conduit 150) leaving the chilled beams (e.g., 170) after leaving the (e.g., pressure regulation) device (180). The hot water control valve (e.g., 192) is modulated, in this particular embodiment, to allow for the introduction of the amount of hot water needed to achieve the desired chilled beam heating supply water temperature called for by the controller (e.g., 190) and measured at the supply water temperature sensor (e.g., 175). The hot water control valve (e.g., 192) accomplishes this by discharging the amount of return water necessary into the main heating return water loop (e.g., 104) to allow the appropriate quantity of incoming hot water.

In other embodiments, at least one of the chilled-water inlet valve (e.g., 110), the chilled-water outlet valve (e.g., 130), the warm-water inlet valve (e.g., 120), or the warm-water outlet valve (e.g., 140) is a three-way control valve. Moreover, in particular embodiments, the first control valve (e.g., 191) is a three-way control valve and the second control valve (e.g., 192) is a three-way control valve. Using three-way control valves can eliminate the need for other valves or devices (e.g., device 180), in some embodiments, can reduce the amount of pump energy required, or both, as examples.

In a particular alternative embodiment, for example, two-way control valves 191 and 192 shown in FIG. 1 are omitted, and in their place, two three-way valves are substituted, for instance, located in place of the tees above where control valves 191 and 192 are shown in FIG. 1. In this example, these three-way valves are located in the line that contains device 180 in FIG. 1, but device 180 is omitted. The three-way valve above where control valve 191 is shown in FIG. 1 could be the chilled-water control valve, in this example, and would allow chilled water to circulate into the supply portion of the conduit (e.g., from cold water supply line 101) when the chilled-water control valve is modulated fully in one direction (i.e., in the maximum cooling direction). When modulated fully in this direction, the chilled water three-way valve would allow no water to recirculate from return portion 154 to supply portion 152 through the chilled water three-way valve. In this mode of operation, water returning from the chilled beam (e.g., 170), would return to the cold water return loop (e.g., 103) through a check valve (e.g., 196), similar to the embodiment shown in FIG. 1. Further, in this example, the three-way chilled-water control valve would allow water returning from the chilled beam to recirculate into the supply portion of the conduit (e.g., from return portion 154) when the chilled-water control valve is modulated fully in the other direction (i.e., when no cooling is being provided). When modulated fully in this direction, the chilled water three-way valve would allow no water to circulate from cold water supply 101 to supply portion 152 through the chilled water three-way valve. When partially modulated, between these two extremes, the chilled-water control valve would allow some chilled water to circulate into the supply portion of the conduit (e.g., from cold water supply line 101) and would allow some water returning from the chilled beam to recirculate into the supply portion of the conduit (e.g., from return portion 154).

Similarly, in this same alternative example, the three-way valve above where control valve 192 is shown in FIG. 1 could be the warm-water control valve, in this example, and would allow return water from the chilled beam (e.g., 170) to circulate out of the return portion of the conduit (e.g., to hot water return line 104) when the warm-water control valve is modulated fully in one direction (i.e., in the maximum heating direction). In this mode of operation, water entering the chilled beam (e.g., 170), would enter from the hot water supply loop (e.g., 102) through a check valve (e.g., 197), similar to the embodiment shown in FIG. 1. When modulated fully in this direction, the warm water three-way valve would allow no water to recirculate from return portion 154 to supply portion 152 through the warm water three-way valve. In this example, however, the three-way warm-water control valve would allow water returning from the chilled beam to recirculate into the supply portion of the conduit (e.g., from return portion 154 to supply portion 152) when the warm-water control valve is modulated fully in the other direction (i.e., when no heating is being provided). When modulated fully in this direction, the warm water three-way valve would allow no water to circulate from return portion 154 to return line 104 through the chilled water three-way valve. When partially modulated, between these two extremes, the warm-water control valve would allow some return water to circulate from the return portion of the conduit (e.g., to hot water return line 104), so that an equal amount of hot water would enter supply portion 152 through hot water check valve 197 and would allow some water returning from the chilled beam to recirculate into the supply portion of the conduit (e.g., from return portion 154).

Still other embodiments combine multiple valves described herein into one or more multi-function valves or devices. In one such example, the two three-way valves just described are combined into a single multi-function valve. In another example, two-way control valves 191 and 192 and device 180 shown in FIG. 1 are combined into one multi-function device. In some such embodiments, the check valves remain as separate devices, but in still other embodiments, the check valves can be integrated with the multi-function valve or device. Still other combinations may be apparent to a person of ordinary skill in the art.

In a number of embodiments, the zone pump module (e.g., 100) allows at least two configurations for the chilled and hot water piping loops, the traditional 4 pipe arrangement or a 2 pipe arrangement. Simply put, the 4 pipe arrangement uses a chilled water supply pipe loop, a chilled water return pipe loop, a hot water supply pipe loop and a hot water return pipe loop—thus the 4 pipe designation. FIG. 1 illustrates such a 4 pipe configuration. In this embodiment, the hot water supply (e.g., valve 120 or piping connecting thereto) is connected to the hot water supply loop (e.g., 102) and the hot water return (e.g., valve 140 or piping connected thereto) is connected to a separate hot water return loop (e.g., 104). Likewise, the chilled water supply (e.g., valve 110 or piping connecting thereto) is connected to the chilled water supply loop (e.g., 101 and the chilled water return (e.g., valve 130 or piping connecting thereto) is connected to a separate chilled water return loop (e.g., 103).

In contrast, in various embodiments, a 2 pipe arrangement uses only a single chilled water pipe loop and a single hot water pipe loop, thus, the 2 pipe designation. In both cases, the return water leaving the zone pump module is delivered back to the same chilled or hot water loop, and the loop temperature therefore changes as the loop is routed throughout the building. Adapting FIG. 1 to this 2 pipe case, both the hot water supply (e.g., valve 120 or piping connecting thereto) and the hot water return (e.g., valve 140 or piping connecting thereto) would be connected to the single hot water loop. Likewise, both the chilled water supply (e.g., valve 110 or piping connecting thereto) and chilled water return (e.g., valve 130 or piping connecting thereto) are connected to the single chilled water loop. As mentioned, an example of a 2 pipe arrangement is shown in FIG. 2.

FIG. 2 illustrates zone pump module 100 installed in a two-pipe system instead of a four-pipe system, reducing the amount of piping required. In this embodiment, valves 110, 120, 130, and 140 are connected to chilled water supply line 111 and warm water supply line 121 as shown. In the embodiment illustrated, zone pump module 100 can be installed in either a two-pipe or a four-pipe system having both cooling and heating capability. Further, in some embodiments, a zone pump module can be installed in either a one-pipe or a two-pipe system having just cooling capacity and no heating capacity. Further still, in some embodiments, a zone pump module can be installed in either a one-pipe or a two-pipe system where either cooling capacity or heating capacity can be provided depending on whether chilled water or heated water is distributed through the water distribution system. In this later example, it may not be possible to heat some zones with the chilled beams while other zones are being cooled. In some embodiments, however, some other heating or cooling can be provided to some or all of the zones.

Figure 3:
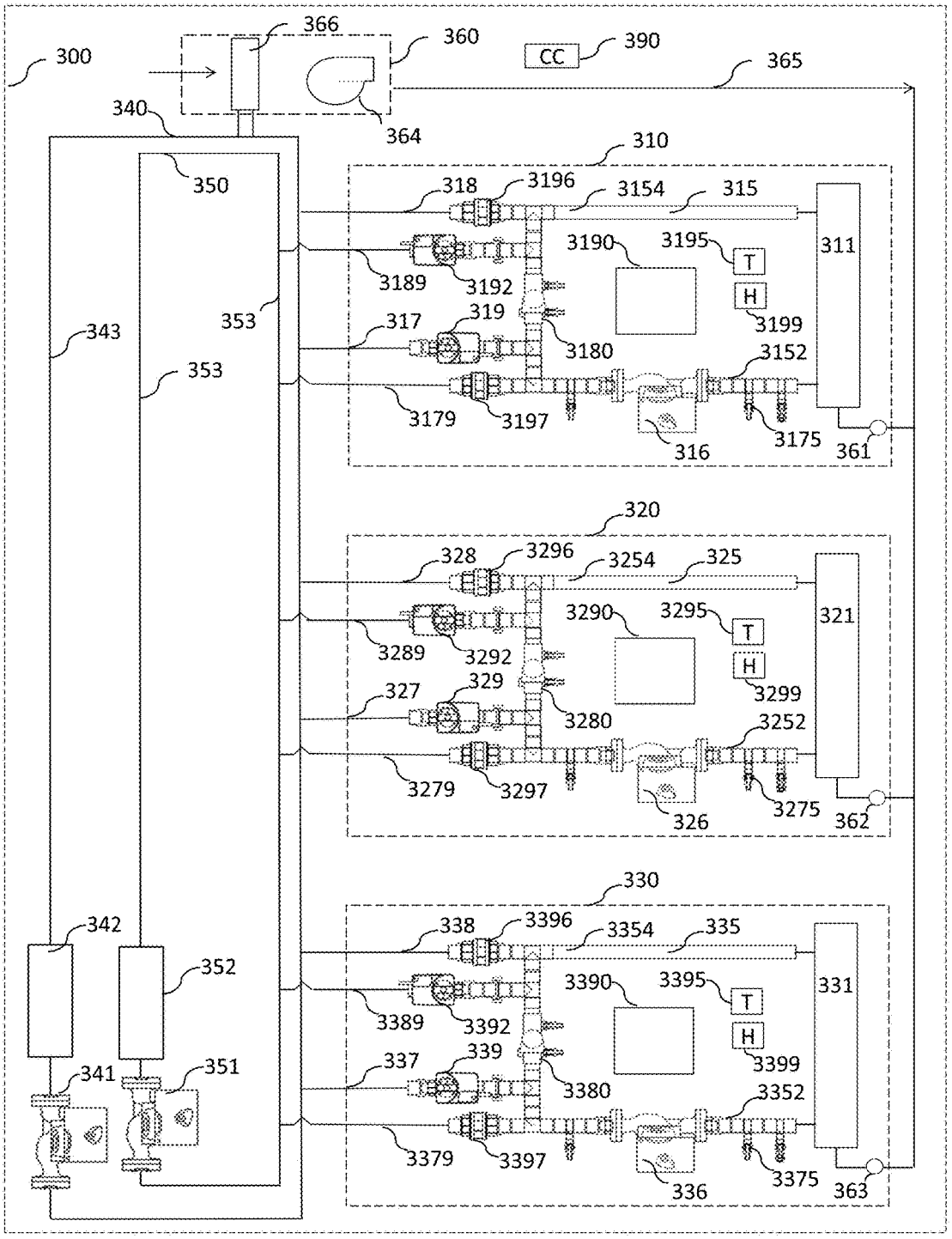
FIG. 3 is a block diagram illustrating various components of an example of a multiple-zone chilled beam air conditioning system for cooling a multiple-zone space.

FIG. 3 illustrates an example of a multiple-zone chilled beam air conditioning system for cooling a multiple-zone space, system 300. In this embodiment, multiple-zone chilled beam air conditioning system 300 includes zones 310, 320, and 330. Although three zones are shown, other embodiments may have 2, 4, 5, 6, 7, 8, 9, 10, 11, 12, 13, 14, 15, 16, 18, 20, 22, 25, or another number of zones, as examples. Further, in this embodiment, multiple-zone chilled beam air conditioning system 300 includes chilled-water distribution system 340 that includes chilled water circulation pump 341, chiller 342, and single-pipe chilled water loop 343. In this particular embodiment, chilled water circulation pump 341 circulates chilled water through chiller 342 and through chilled water loop 343. Various embodiments include at least one chilled water circulation pump (e.g., 341), at least one chiller (e.g., 342), and a chilled water loop (e.g., 343. Other embodiments use a two-pipe system (e.g., pipes 101 and 103 shown in FIG. 1). Thus, in a number of embodiments, the chilled-water distribution system (e.g., 340) includes only one chilled water loop (e.g., 343) rather than a chilled water supply loop and a separate chilled water return loop, while in other embodiments, the chilled-water distribution system (e.g., 340) includes a chilled water supply loop and a separate chilled water return loop (e.g., pipes 101 and 103 shown in FIG. 1).

In the embodiment illustrated, each of the multiple zones 310, 320, and 330, includes at least one chilled beam (e.g., 311, 321, and 331, respectively), a conduit (e.g., 315, 325, and 335, respectively) for passing water therethrough and through the (e.g., at least one) chilled beam, and for recirculating the water therein for controlling temperature of the (e.g., at least one) chilled beam (e.g., 311, 321, and 331, respectively). In a number of embodiments, the conduit (e.g., 315, 325, and 335) includes a supply portion for supplying the water to the (e.g., at least one) chilled beam and a return portion for returning water from the (e.g., at least one) chilled beam. Examples of a supply portion (e.g., 152) and a return portion (e.g., 154) are described above with reference to FIG. 1. In the embodiment shown in FIG. 3, conduits 315, 325, and 335 include supply portions 3152, 3252, and 3352, respectively, for supplying the water to chilled beams 311, 321, and 331, respectively, and return portions 3154, 3254, and 3354, respectively, for returning water from the chilled beams 311, 321, and 331, respectively. In a number of embodiments, the return portion (e.g., 3154, 3254, and 3354) is connected to the supply portion (e.g., 3152, 3252, and 3352, respectively) for recirculating the water in the conduit and in the (e.g., at least one) chilled beam for controlling the temperature of the (e.g., at least one) chilled beam.

Also in the embodiment shown in FIG. 3, each zone 310, 320, and 330 includes a zone pump (e.g., 316, 326, and 336, respectively) mounted in the conduit (e.g., 315, 325, and 335, respectively) for passing the water through the conduit and through the (e.g., at least one) chilled beam (e.g., 311, 321, and 331, respectively), and for recirculating the water in the conduit and in the (e.g., at least one) chilled beam for controlling the temperature of the (e.g., at least one) chilled beam. In different embodiments, the zone pump is mounted in the supply portion (e.g., 3152, 3252, or 3352) of the conduit (e.g., 315, 325, or 335, respectively) or in the return portion (e.g., 3154, 3254, or 3354, respectively) of the conduit. In the embodiment shown, zone pumps 316, 326, and 336, are mounted in the supply portions 3152, 3252, and 3352, respectively, of the conduits 315, 325, and 335, respectively. Further, in a number of embodiments, each zone (e.g., 310, 320, or 330) has only one zone pump (e.g., 316, 326, or 336, respectively), for example, and no other water pump. In addition, in the embodiment depicted, each zone 310, 320, and 330 includes a chilled-water inlet (e.g., 317, 327, and 337, respectively) for passing water from chilled water loop 343 to the conduit (e.g., 315, 325, and 335, respectively), and a chilled-water outlet (e.g., 318, 328, and 338, respectively) for passing water from the conduit to chilled water loop 343. In various embodiments, the chilled-water inlet (e.g., 317, 327, or 337) is connected to the supply portion (e.g., 3152, 3252, or 3352, respectively) of the conduit (e.g., 315, 325, or 335, respectively) and the chilled-water outlet (e.g., 318, 328, or 338, respectively) is connected to the return portion (e.g., 3154, 3254, or 3354, respectively) of the conduit.

Further, various embodiments include a chilled water control valve for passing chilled water between the chilled water loop (e.g., 343) and the conduit (e.g., 315, 325, or 335). As used herein, in this context "between" means in either direction (e.g., from the chilled water loop to the conduit or from the conduit to the chilled water loop, or both). In this embodiment, valves 319, 329, and 339 are the chilled water control valves located in the chilled-water inlets (e.g., 317, 327, and 337, respectively). In other embodiments, however, the chilled water control valves can be located in the chilled-water outlets (e.g., 318, 328, and 338), as another example. Thus, in different embodiments, the chilled water control valve (e.g., 319, 329, or 339) can be located in the chilled-water inlet (e.g., 317, 327, or 337, respectively) or in the chilled-water outlet (e.g., 318, 328, or 338, respectively).

Even further, in multiple-zone chilled beam air conditioning system 300 of FIG. 3, each zone 310, 320, and 330 further includes a water temperature sensor (e.g., 3175, 3275, and 3375, respectively) and a digital controller (e.g., 3190, 3290, and 3390, respectively). In this embodiment, these digital controllers are each specifically configured to control at least the chilled water control valve (e.g., 319, 329, and 339, respectively) in that zone based upon input from the space or zone temperature sensor (e.g., 3175, 3275, or 3375, respectively) to control temperature of the water delivered to the (e.g., at least one) chilled beam (e.g., 311, 321, or 331, respectively). Even further still, multiple-zone chilled beam air conditioning system 300 further includes a space or zone temperature sensor or thermostat (e.g., 3195, 3295, and 3395) located within each zone (e.g., 310, 320, and 330, respectively) to control temperature of that zone. In a number of embodiments, the digital controller (e.g., 3190, 3290, and 3390) is further specifically configured to control at least the chilled water control valve (e.g., 319, 329, or 339, respectively) based upon input from the zone temperature sensor or thermostat (e.g., 3195, 3295, or 3395, respectively).

Moreover, in the embodiment illustrated, multiple-zone chilled beam air conditioning system 300 further includes a zone humidistat (e.g., 3199, 3299, and 3399), for example, located within each zone (e.g., 310, 320, and 330, respectively). In a number of embodiments, the digital controller (e.g., 3190, 3290, and 3390) is further specifically configured to control at least the chilled water control valve (e.g., 319, 329, or 339, respectively) serving the zone (e.g., 310, 320, or 330, respectively) based upon input from the humidistat (e.g., 3199, 3299, or 3399, respectively) to control the temperature of the (e.g., at least one) chilled beam (e.g., 311, 321, or 331, respectively) to keep the temperature of the (e.g., at least one) chilled beam above a present dew point temperature within that zone. This example is for a single pipe design (e.g., pipe 343), where the zone pump module pulls cold water from the supply loop then ejects return water from the zone pump module back into the same loop. With this embodiment, the chilled water loop (e.g., 340) temperature rises as it serves each zone (e.g., 310, 320, and 330) and passes through the building. The first beam (e.g., 311) on the loop sees the coldest water while the last beam (e.g., 331) on the loop has access to much warmer chilled water. As a result, the first zone (e.g., 310) requires only a small amount of very cold chilled water while the last zone (e.g., 330) requires that a much larger portion of the more moderate temperature chilled water be introduced to the pump (e.g., 336) to deliver the water temperature required by the chilled beams (e.g., 331).

Further, various embodiments include a warm-water distribution system that includes at least one warm water circulation pump, at least one water heater, and a warm water loop. In the embodiment illustrated in FIG. 3, for example, multiple-zone chilled beam air conditioning system 300 further includes warm-water distribution system 350 that includes warm water circulation pump 351, water heater 352, and warm water loop 353. In a number of embodiments, the warm water circulation pump (e.g., 351 circulates (e.g., warm or hot) water through the (e.g., at least one) water heater (e.g., 352) and through the warm water loop (e.g., 353). Further, in the embodiment shown, warm-water distribution system 350 includes only one warm water loop 353 rather than a warm water supply loop and a separate warm water return loop. Other embodiments, however, can include a warm water supply loop and a separate warm water return loop (e.g., 102 and 104 shown in FIG. 1).

Moreover, in a number of embodiments that include a warm-water distribution system (e.g., 350), each zone (e.g., 310, 320, and 330) further includes a warm-water inlet for passing water from the warm water loop to the conduit, a warm-water outlet for passing water from the conduit to the warm water loop, and a warm water control valve for passing warm water between the warm water loop and the conduit, for example. For example, in the embodiment illustrated, multiple-zone chilled beam air conditioning system 300 further includes warm-water inlets 3179, 3279, and 3379, for zones 310, 320, and 330 respectively, for passing water from warm water loop 353 to conduits 315, 325, and 335, respectively. Moreover, in the embodiment illustrated, multiple-zone chilled beam air conditioning system 300 further includes warm-water outlets 3189, 3289, and 3389, for zones 310, 320, and 330, respectively, for passing water from conduits 315, 325, and 335, respectively, to warm water loop 353 of warm-water distribution system 350. Further, in the embodiment illustrated, multiple-zone chilled beam air conditioning system 300 further includes warm-water control valves 3192, 3292, and 3392, for zones 310, 320, and 330, respectively, for passing water between warm water loop 353 and conduits 315, 325, and 335, respectively.

In a number of embodiments, in each zone, the warm water control valve is located in the warm-water inlet or in the warm-water outlet. In the particular embodiment depicted, warm-water control valves 3192, 3292, and 3392 are located in warm-water outlets 3189, 3289, and 3389, respectively. In other embodiments, however, warm-water control valves can be located in warm-water inlets (e.g., 3179, 3279, and 3379), as another example. Other embodiments may differ. Further, in a number of embodiments, including in the embodiment shown, the warm-water inlet (e.g., 3179, 3279, or 3379) is connected to the supply portion (e.g., 3152, 3252, or 3352, respectively) of the conduit (e.g., 315, 325, or 335, respectively) and the warm-water outlet (e.g., 3189, 3289, or 3389, respectively) is connected to the return portion (e.g., 3154, 3254, or 3354, respectively) of the conduit.

In a number of embodiments, in each zone, one of the chilled water control valve or the warm-water control valve is connected to the supply portion of the conduit and the other of the chilled water control valve or the warm-water control valve is connected to the return portion of the conduit. In the embodiment shown, for example, in each zone (e.g., 310, 320, and 330), the chilled water control valve (319, 329, and 339, respectively) is connected to the supply portion (e.g., 3152, 3252, and 3352, respectively) of the conduit (e.g., 315, 325, and 335, respectively) and the warm-water control valve (3192, 3292, and 3392, respectively) is connected to the return portion (e.g., 3154, 3254, and 3354, respectively) of the conduit. In other embodiments, however, in each zone, or in some of the zones, the warm-water control valve is connected to the supply portion of the conduit and the chilled water control valve is connected to the return portion of the conduit, as another examples. Other embodiments may differ. Further, in a number of embodiments, the chilled water control valve is a two-way control valve, the warm water control valve is a two-way control valve, or both. In the embodiment illustrated, for example, chilled water control valves 319, 329, and 339 are each two-way control valves and warm water control valves 3192, 3292, and 3392 are each two-way control valves. In other embodiments, however, the chilled water control valve or the warm water control valve can be a three-way control valve. Further, in certain embodiments, the chilled water control valve is a three-way control valve and the warm water control valve is a three-way control valve. An example of a configuration using three-way control valves is described in more detail above with reference to FIG. 1.

In various embodiments, one of the chilled-water inlet (e.g., 317, 327, and 337, in zones 310, 320, and 330, respectively) or the chilled-water outlet (e.g., 318, 328, and 338, in zones 310, 320, and 330, respectively) includes a check valve. Further, in a number of embodiments, for example, in each zone, one of the warm-water inlet or the warm-water outlet includes a check valve, one of the chilled-water inlet or the chilled-water outlet includes a check valve, or both. Even further, in various embodiments, one of the chilled-water inlet or the warm-water inlet includes a check valve, one of the chilled-water outlet or the warm-water outlet includes a check valve, or both. In the particular embodiment illustrated, for instance, in each zone 310, 320, and 330, warm-water inlets 3179, 3279, and 3379, respectively, include first check valves 3197, 3297, and 3397, respectively. Moreover, in the embodiment shown, chilled-water outlets 318, 328, and 338 include second check valves 3196, 3296, and 3396, respectively. In other embodiments, on the other hand, the chilled-water inlet includes a first check valve, and the warm-water outlet includes a second check valve, as another example. Still other embodiments use control valves instead of check valves, such as two-way control valves or three-way control valves, as other examples.

In various embodiments, there are two check valves in each zone, two (e.g., two-way) control valves in each zone, or both. Certain embodiments, such as the embodiment illustrated, include exactly two check valves and exactly two (e.g., two-way) control valves in each zone. Further, in a number of embodiments, including the embodiment shown, one of the check valves serves as an inlet valve, while the other check valve serves as an outlet valve. Moreover, in a number of embodiments, including the embodiment shown, one of the control valves serves as an inlet valve, while the other control serves as an outlet valve. In the embodiment shown, for example. there are two check valves in each zone (e.g., 3196 and 3197 in zone 310, 3296 and 3297 in zone 320, and 3396 and 3397 in zone 330). Further, this particular embodiment has two two-way control valves (e.g., 319 and 3192 in zone 310, 329 and 3292 in zone 320, and 339 and 3392 in zone 330), and two check valves (e.g., 3196 and 3197 in zone 310, 3296 and 3297 in zone 320, and 3396 and 3397 in zone 330) in each zone, and one of the check valves (e.g., 3197 in zone 310, 3297 in zone 320, and 3397 in zone 330) serves as an inlet valve, while the other check valve (e.g., 3196 in zone 310, 3296 in zone 320, and 3396 in zone 330) serves as an outlet valve. Moreover, one of the control valves (e.g., 319 in zone 310, 329 in zone 320, and 339 in zone 330) serves as an inlet valve, while the other control valve (e.g., 3192 in zone 310, 3292 in zone 320, and 3392 in zone 330) serves as an outlet valve.

In a number of embodiments (e.g., in each zone), one of the warm-water inlet or the warm-water outlet includes a check valve, one of the chilled-water inlet or the chilled-water outlet includes a check valve, one of the chilled-water inlet or the warm-water inlet includes a check valve, and one of the chilled-water outlet or the warm-water outlet includes a check valve. In the embodiment shown, for example (e.g., in each zone), warm-water inlets 3179, 3279, and 3379 each include check valves 3197, 3297, and 3397, respectively, and chilled-water outlets 318, 328, and 338 each include check valves 3196, 3296, and 3396, respectively, but chilled-water inlets 317, 327, and 337 each do not include a check valve, and warm-water outlets 3189, 3289, and 3389, each do not include a check valve. Rather, in this embodiment, chilled-water inlets 317, 327, and 337 each include control valves 319, 329, and 339, respectively, and warm-water outlets 3189, 3289, and 3389, each include control valves 3192, 3292, and 3392, respectively.

In the embodiment shown, digital controllers 3190, 3290, and 3390 are specifically configured to control (e.g., at least) chilled water control valves 319, 329, and 339, respectively, and warm water control valves 3192, 3292, and 3392, respectively, based upon input from zone temperature sensors 3175, 3275, and 3375, respectively, to control temperature of the water delivered to the (e.g., at least one) chilled beam (e.g., 311, 321, and 331, respectively). Moreover, in this embodiment, digital controllers 3190, 3290, and 3390 are specifically configured to control (e.g., at least) chilled water control valves 319, 329, and 339, respectively, and warm water control valves 3192, 3292, and 3392, respectively, based upon input from zone temperature sensors or thermostats 3195, 3295, and 3395, respectively, to control the temperature (e.g., space temperature) of zones 310, 320, and 330, respectively. In some embodiments, digital controllers 3190, 3290, and 3390, for example, can be discrete devices, for instance, each having a separate microprocessor, but in other embodiments, digital controllers 3190, 3290, and 3390 can be part of the same computer or controller, as another example, controlling multiple zones simultaneously.

In certain embodiments, each zone pump, for example, 316, 326, and 336, is a multiple-speed zone pump. In other embodiments, just some of the zone pumps are multiple-speed pumps, as another example. In particular embodiments, for example, in multiple zones, each zone pump is a multiple-speed pump, as another example or a variable-speed pump, as yet another example. As used herein, "multiple-speed", in this context, includes pumps that operate at two or more non-zero speeds, and pumps that operate at any speed within a range of speeds (e.g., variable-speed pumps), as examples. In a number of embodiments, the digital controller, for instance, 3190, 3290, 3390, or a combination thereof, is further specifically configured to control speed of the zone pump (e.g., 316, 326, or 336, respectively, for zones 310, 320, and 330), for instance, based (e.g., at least) upon input from the zone temperature sensor or thermostat (e.g., 3195, 3295, or 3395) located within the (e.g., at least one) zone, for example, to control temperature of the (e.g., at least one) zone (e.g., 310, 320, or 330, respectively). In other embodiments, however, each zone pump, for example, 316, 326, and 336, or some such pumps, can be a single-speed zone pump, as another example.

Multiple-zone chilled beam air conditioning system 300 further includes, in the embodiment shown, devices (e.g., pressure regulation devices) 3180, 3280, and 3380, connecting supply portions 3152, 3252, and 3352 of conduits 315, 325, and 335 to return portions 3154, 3254, and 3354 of the conduits, respectively, for recirculating the water in the conduits and in the (e.g., at least one) chilled beams (e.g., 311, 321, and 331, respectively) and for restricting flow of the water from the return portion to the supply portion to provide for flow of the water through (e.g., in a cooling mode) the chilled-water inlet (e.g., 317, 327, and 337, respectively) and the chilled-water outlet (e.g., 318, 328, and 338, respectively) for controlling temperature of the (e.g., at least one) chilled beam (e.g., 311, 321, and 331, respectively). In a number of embodiments, the (e.g., pressure regulation) device (e.g., 3180, 3280, and 3380, for zones 310, 320, and 330, respectively) also provides for restricting flow of the water from the return portion to the supply portion to provide for flow of the water, in a heating mode, through the warm-water inlet (e.g., 3179, 3279, and 3379, respectively) and the warm-water outlet (e.g., 3189, 3289, and 3389, respectively) for controlling temperature of the (e.g., at least one) chilled beam (e.g., 311, 321, and 331, respectively).

In a number of embodiments, each zone includes a device or pressure regulation device (e.g., 3180, 3280, or 3380) connecting the supply portion of the conduit to the return portion of the conduit for recirculating the water in the conduit and in the (e.g., at least one) chilled beam (i.e., in that zone) and for restricting flow of the water from the return portion to the supply portion to provide for flow of the water through the chilled-water inlet and the chilled-water outlet for controlling temperature of the (e.g., at least one) chilled beam. Further, in certain embodiments, such a device or pressure regulation device (e.g., 3180, 3280, or 3380) connecting the supply portion of the conduit to the return portion of the conduit can provide for flow of the water through the warm-water inlet (e.g., 3179, 3279, or 3379) and the warm-water outlet (e.g., 3189, 3289, or 3389, respectively) for controlling temperature of the (e.g., at least one) chilled beam. In some embodiments, the device or pressure regulation device (e.g., 3180, 3280, or 3380) includes a flow meter. Moreover, in particular embodiments, the device or pressure regulation device (e.g., 3180, 3280, or 3380) is a circuit setter. Further, in certain embodiments, the device or pressure regulation device (e.g., 3180, 3280, or 3380) is an automatic pressure regulation device that maintains a substantially constant pressure loss across the pressure regulation device as the flow through the pressure regulation device varies over a range of flows. In still other embodiments, the device (e.g., 3180, 3280, or 3380) can be an orifice, a restriction in the conduit, a smaller size section of pipe or conduit, a manual valve, or a control valve, as other examples.

In various embodiments, at least one chilled beam in each zone, for example, is an active chilled beam, and the multiple-zone chilled beam air conditioning system further includes an outside air delivery system delivering outside air to the (e.g., at least one) chilled beam (e.g., in each zone). Still referring to FIG. 3, in the embodiment shown, chilled beams 311, 321, and 331 in zones 310, 320, and 330, respectively, are each active chilled beams, and multiple-zone chilled beam air conditioning system 300 further includes outside air delivery system 360 delivering outside air to chilled beams 311, 321, and 331 in zones 310, 320, and 330, respectively. In this embodiment, outside air delivery system 360 includes outdoor air heat exchanger 366, fan 364, duct 365, control dampers 361, 362, and 363 (for chilled beams 311, 321, and 331 in zones 310, 320, and 330, respectively), and central controller 390. In this embodiment, outdoor air heat exchanger 366 chills and dehumidifies outside air using chilled water from chilled-water distribution system 340 delivered by chilled water circulation pump 341 from chiller 342 through single-pipe chilled water loop 343. In this single-pipe system, chilled water is delivered to outdoor air heat exchanger 366 from chiller 342 before being delivered to the chilled beams (e.g., 311, 321, and 331) so the chilled water will be coldest at outdoor air heat exchanger 366 to promote dehumidification of the outside air. Other embodiments may differ. Further, other embodiments omit control dampers 361, 362, and 363. Some embodiments have an outdoor air fan (e.g., analogous to fan 364) for each zone. Further, in certain embodiments, the outdoor air fan (e.g., 364) or fans are multiple or variable speed fans. In some such embodiments, the speed of the outdoor air fan or fans is controlled by the central controller (e.g., 390), or in particular embodiments where each zone has an outdoor air fan, by the zone controller (e.g., 3190, 3290, and 3390, for zones 310, 320, and 330, respectively), as examples.

In the particular embodiment shown, central controller 390 is specifically configured to control dampers 361, 362, and 363 to control the amount of outside air, dehumidified air, or both, that is delivered to each zone (e.g., 310, 320, and 330). Further, in certain embodiments, outdoor air fan 364 is a variable-speed fan, and central controller 390 is specifically configured to control the speed of fan 364. For example, in particular embodiments, central controller 390 is specifically configured to keep at least one of dampers 361, 362, and 363 fully open at all times and to adjust the speed of fan 364 so as to provide the amount of outdoor air deemed to be appropriate for the zone or zones for which the damper (e.g., 361, 362, or 363) is fully open. The damper may be kept fully open, for instance, for the zone that requires the most outside air at the time, for example. In some embodiments, however, it may be appropriate to keep a damper fully open for a zone that has more restriction in the ductwork (e.g., 365), for instance, due to a longer length of ductwork, due to more turns in the ductwork, or both, even if that zone requires less outside air than another zone that has less restriction. Further, in some embodiments, it may be appropriate to keep a damper fully open for a zone that has a greater static pressure in the zone, for instance, due to having doors and windows closed, due to having fewer vents in the room, due to the room being better sealed, or a combination thereof, even if that zone requires less outside air than another zone that has less static pressure. The other dampers (e.g., 361, 362, or 363) for the other zones, that are not fully open, in this example, are then adjusted by controller 390 to provide the amount of outdoor air deemed to be appropriate for those zones (or that zone, if only one zone has a damper that is not fully open).

Further, in this particular embodiment, each zone (e.g., 310, 320, and 330, shown in FIG. 3) includes at least one zone humidistat (e.g., 3199, 3299, and 3399, respectively), for instance, located within the zone, or sensing within the zone, and central controller 390 is specifically configured to use readings from the humidistats (e.g., 3199, 3299, and 3399) to control how much humidity is removed from the outside air in outside air delivery system 360 delivering outside air to the (e.g., at least one) chilled beam (e.g., 311, 321, and 331) in each zone (e.g., 310, 320, and 330). In various embodiments, central controller 390 can control, for instance, the temperature of water chilled by chiller 342, the amount of chilled water delivered to heat exchanger 366, or both, for example, as well as or instead of the speed of fan 364, the position of a combination of dampers 361, 362, and 363, or a combination thereof. Further, in some embodiments, zone controllers 3190, 3290, 3390, or a combination thereof, may communicate with, or may be combined with, central controller 390.

A particular example of an embodiment is a multiple-zone chilled beam air conditioning system (e.g., 300) for cooling a multiple-zone space (e.g., zones 310, 320, and 330), the multiple-zone chilled beam air conditioning system including a chilled-water distribution system (e.g., 340) that includes at least one chilled water circulation pump (e.g., 341), at least one chiller (e.g., 342), and a (e.g., at least one) chilled water loop (e.g., 343). In a number of embodiments, the chilled water circulation pump (e.g., 341) circulates chilled water through the (e.g., at least one) chiller (e.g., 342) and through the chilled water loop (e.g., 343). In various embodiments, the multiple-zone chilled beam air conditioning system (e.g., 300) can further include multiple zones (e.g., 310, 320, and 330), each zone including (e.g., at least one) chilled beam (e.g., 311, 321, and 331), a conduit (e.g., 315, 325, and 335) for passing water therethrough and through the (e.g., at least one) chilled beam (e.g., 311, 321, and 331), and for recirculating the water therein for controlling temperature of the (e.g., at least one) chilled beam (e.g., 311, 321, and 331). In a number of embodiments, the conduit (e.g., 315, 325, and 335) includes a supply portion (e.g., 3152, 3252, and 3352) for supplying the water to the (e.g., at least one) chilled beam and a return portion (e.g., 3154, 3254, and 3354) for returning water from the (e.g., at least one) chilled beam, wherein the return portion is connected to the supply portion for recirculating the water in the conduit and in the (e.g., at least one) chilled beam for controlling the temperature of the (e.g., at least one) chilled beam.

In various embodiments, each zone (e.g., 310, 320, and 330) can further include a zone pump (e.g., 316, 326, and 336) mounted in the conduit (e.g., 315, 325, and 335) for passing the water through the conduit and through the (e.g., at least one) chilled beam (e.g., 311, 321, and 331, respectively), and for recirculating the water in the conduit and in the (e.g., at least one) chilled beam for controlling the temperature of the (e.g., at least one) chilled beam. In different embodiments, the zone pump can be mounted in the supply portion (e.g., 3152, 3252, and 3352) of the conduit or in the return portion (e.g., 3154, 3254, and 3354) of the conduit, as examples. Each zone (e.g., 310, 320, and 330) can further include a chilled-water inlet (e.g., 317, 327, or 337) for passing water from the chilled water loop (e.g., 343) to the conduit, a chilled-water outlet (e.g., 318, 328, or 338) for passing water from the conduit to the chilled water loop, and a chilled water control valve (e.g., 319, 329, or 339) for passing chilled water between the chilled water loop and the conduit. Moreover, each zone (e.g., 310, 320, and 330) can further include a pressure regulation device (e.g., 3180, 3280, or 3380) connecting the supply portion of the conduit to the return portion of the conduit for recirculating the water in the conduit and in the (e.g., at least one) chilled beam and for restricting flow of the water from the return portion to the supply portion to provide for flow of the water through the chilled-water inlet and the chilled-water outlet for controlling temperature of the (e.g., at least one) chilled beam. In a number of embodiments, the chilled water control valve is located in the chilled-water inlet or in the chilled-water outlet, the chilled-water inlet is connected to the supply portion of the conduit and the chilled-water outlet is connected to the return portion of the conduit.

In a number of embodiments, closed chilled water and hot water systems (e.g., 340 and 350, respectively) are used to avoid transferring water between the chilled water and hot water systems. If a cold water loop (e.g., 343) is designed as an open system (e.g., using a non-pressure regulated expansion tank), then, in the embodiment illustrated, for example, the cold water return check valve (e.g., 196 shown in FIGS. 1 and 2 or 3196, 3296, or 3396 shown in FIG. 3) can be replaced with a control valve, such as a shut-off control valve (e.g., a two-way shut-off control valve) that remains closed when not in the cooling mode to avoid the possibility of dumping some of the returning hot water into the chilled water return loop even when the chilled water control valve is closed. As used herein, a "shut-off control valve" or a "two-position control valve" is a control valve that is operated automatically, for instance, by a controller, but that is normally either fully open or fully closed rather than being designed to remain at any one of many different points between fully open and fully closed to adjust and control flow through the valve. The hot water supply check valve (e.g., 3197, 3297, and 3397 shown in FIG. 3, for zones 310, 320, and 330, respectively), in this embodiment (i.e., with a control valve in place of chilled water check valve 3196, 3296, and 3396, respectively), could still be used provided hot water loop 353 is a closed system. No significant quantity of water can be introduced into a closed system without simultaneously removing water from the same system. The reverse is also true. This principle allows the effective operation of the zone pump module (e.g., 100 shown in FIGS. 1 and 2) as shown and described. Open systems can be accommodated, however, in some embodiments, particularly if the check valves (e.g., 196 and 197 shown in FIGS. 1 and 2 or 3196, 3296, 3396, 3197, 3297, and 3397 shown in FIG. 3) are replaced with control valves, such as two-position control valves, for example, that can be modulated to full open or closed, based on a call for heating or cooling.

In a number of embodiments, the position of the check valves (e.g., 196 and 197 shown in FIGS. 1 and 2) and control valves (e.g., 191 and 192) can be changed into certain other configurations. For example the position of the supply chilled water control valve (e.g., 191) and the supply hot water check valve (e.g., 197) can be switched in some embodiments. Likewise, the return chilled water check valve (e.g., 196) and the return hot water control valve (e.g., 192) can be also be switched. Finally, the position of the cooling control valve (e.g., 191) and check valve (e.g., 196) can be switched and the heating control valve (e.g., 192) and check valve (e.g., 197) can be switched provided that the check valves are correctly positioned to open in the direction of water flow. Moreover, the zone pump (e.g., 160) can be moved from the supply portion (e.g., 152) to the return portion (e.g., 154) and reversed in direction, in certain embodiments.

The location of the components shown, however, represents a particular example of positioning of the components that can have advantages over other alternatives. As shown, a check valve (e.g., 3197 shown in zone 310 in FIG. 3) is located at the hot water supply inlet (e.g., 3179) with the modulating control valve (e.g., 3192) positioned at the hot water return outlet (e.g., 3189). Conversely, a control valve (e.g., 319) is located at the chilled water inlet (e.g., 317) with a check valve (e.g., 3196) positioned at the chilled water return outlet (e.g., 318). This arrangement is beneficial since it guards against an excessive buildup in pressure within the hot water loop (e.g., 353) that could result due to increasing temperature (expansion) if the hot water check valve (e.g., 3197) were located in the return water outlet (e.g., 3189) rather than the supply inlet (e.g., 3179 of zone 310). With the hot water check valve in the return water outlet closing off against the buildup in pressure in the hot water loop (e.g., 353) and the hot water control valve closed, there is no path for the expanding water in the hot water loop (e.g., 353) to go. With the illustrated arrangement, however, any excessive buildup in hot water pressure in the hot water loop (e.g., 353) is avoided since a small amount of hot water can be passed into the zone pump modules to equalize pressure with the chilled water loop (e.g., 343) through the chilled water return check valve (e.g., 3196 in zone 310 in FIG. 3). In addition, since it is common to have the chilled water loop operating at a lower pressure (in some cases under negative pressure), it may be beneficial to have the chilled water check valve (e.g., 3196) located in the chilled water return location (e.g., 318) as buildup of pressure is not a concern.

Employing the localized pumping and control capability offered by the zone pump module (e.g., 100 shown in FIGS. 1 and 2), in a number of embodiments, can provide installation and operational advantages over the prior art chilled-beam system design approach. Addressing the installation complexity, cost, and labor hours associated with a chilled beam installation may be beneficial for two reasons. First, chilled-beam technology is relatively new in markets outside of northern Europe, and there is a benefit to simplifying the overall system design, including piping, beam selection, and controls. Integrating the communications between the zone sensors, chilled beams, water distribution system, and primary air handling systems may be advantageous for both ease of installation and minimizing design, sizing, and selection errors, as examples. Secondly, the greatest single cost associated with a chilled beam cooling/heating system may be the distribution piping in the main cold and hot water loops rather than the chilled beams or controls. Significantly reducing the size, cost and space requirements associated with the distribution piping may be helpful, in a number of embodiments, to achieve widespread acceptance and use of this energy-efficient technology.

When integrating certain embodiments of the zone pump module into a traditional 4 pipe primary water distribution system layout (e.g., as shown in FIG. 1), significant installation advantages can be recognized. These may include, as examples, substantial first cost reductions in the size of the pipe required for the distribution system (e.g., loops 343 and 353), smaller heating and cooling primary pump (e.g., 341 and 351 shown in FIG. 3) size and associated energy use, enhanced chiller (e.g., 342) efficiency associated with a greater water temperature differential between supply and return, and the ability to use a two-pipe chilled beam (e.g., 170, 311, 321, or 331). The ability to use a two-pipe beam coil (same passes for heating and cooling), typically significantly increases the heating or cooling output from a beam of a given length when compared to a traditional 4 pipe beam coil, which uses some passes for heating and others for cooling. Further, this two-pipe beam needs fewer connections and eliminates a significant quantity of piping (approximately one half) that would otherwise be needed within each zone. Moreover, a number of embodiments integrate the control, wiring, control valves and other system components into one prefabricated unit (e.g., zone pump module 100) which greatly simplifies installation while minimizing the chance of errors and performance problems.

As previously discussed, various previous designs require that the water temperature delivered through the chilled and hot water loops (e.g., analogous to 340 and 350, respectively) be the same temperature required for the chilled beams to operate properly. As previously discussed, to avoid condensation during the cooling season and the stratification of heat in the zone during the heating season, these water temperatures are typically about 58 degrees (cooling) and 105 degrees (heating). Typical return water temperatures for the chilled-beam system during cooling with the 58 degree supply water temperature would commonly be in the range of 64 degrees, depending upon a number of system design parameters. Further, during the heating mode, the 105 degree water can be assumed to leave the beams at approximately 96 degrees when using a supply water flow rate that is approximately half that used for cooling. As a result, the cooling delta T (temperature differential) would, in this case, be 6 degrees while the heating delta T would be 9 degrees. If the amount of cooling or heating capacity needed is known for a series of zones, the amount of flow through the heating and cooling loops can be estimated. Knowing the water flow rates and approximate loop length allows for an analysis of both pipe size required and pump energy.

Due to the greater temperature differential, an example of a 4-pipe system described herein (e.g., as illustrated in FIG. 1) provides for substantial reductions in water flow required, pump power and energy, pipe diameter, and installation cost, in comparison with the prior art. Further, due to the reduction in pipe required, further substantial reductions in these parameters can be obtained by using a 2-pipe system (e.g., as illustrated in FIGS. 2 and 3). Thus, whether a 4 pipe distribution is used with the zone pump module (e.g., 100 shown in FIGS. 1 and 2) or a 2 pipe approach, significant benefits are recognized. The benefits include lower flow rates, lower pump (e.g., 341, 351, or both, shown in FIG. 3) energy, smaller pipe size (e.g., 101, 102, 103, and 104 shown in FIGS. 1, 111 and 121 shown in FIG. 2, or 343 and 353 shown in FIG. 3, as examples), and much lower installation cost. This analysis only looks at the energy use and cost associated with the main distribution water loop piping (e.g., 343 and 353 shown in FIG. 3) and installation external to the individual zones (e.g., 310, 320, and 330). The cost savings associated with integration of the zone pump module over that associated with the prior art design, are typically greater than any added cost associated with the zone pump module. So, in various embodiments, significant energy savings, control flexibility, ease of installation and other benefits can often be provided at no additional cost to the owner.

Further, in a number of embodiments, the zone pump module (e.g., 100 shown in FIGS. 1 and 2) allows all passes of the chilled beam coil (e.g., 170) to be use for both heating and cooling. This offers several benefits. First, it allows more cooling and heating output from the beam. When comparing a 4 pipe beam using two passes for heating and 6 passes for cooling with a 2 pipe beam of similar length but using all passes for heating, approximately 13% more cooling output and approximately 30% more heating output is provided by the 2 pipe beam. Often this increased capacity will allow for a shorter 2 pipe beam to be used to process the required cooling or heating load, significantly reducing the cost of the beams needed. Alternatively, the same length beam can be operated with much lower water flows (e.g., from pump 160) to deliver the same cooling and heating output.

Further still, the water distribution piping internal to the zone is dramatically simplified in comparison with prior art designs. With the earlier approach, a 4 pipe chilled beam coil is required. As a result, four pipes are needed to distribute both chilled and hot water to and from each beam. With various embodiments of the zone pump module described herein (e.g., 100), only one set of water distribution piping (e.g., conduit 150) is needed within the zone. Moreover, a significant advantage of certain embodiments of the zone pump module is that the device greatly simplifies the installation process since all key components can be preinstalled as one unit, prewired, and pretested, rather than having this work done at the site. Due to the integration of the (e.g., flow regulation) device (e.g., 180, 3180, 3280, or 3380), in a number of embodiments, that can combine as a flow measurement station, balancing the system is greatly simplified, especially when the local pump (e.g., 160, 316, 326, or 336) can be modulated to provide the pressure needed within the individual zone rather than increasing the pressure of the entire main pump loop (e.g., from the equivalent of pump 341 or 351) to all zones as required by the prior art approach. Depending upon the type of pump (e.g., 160, 316, 326, or 336) chosen for the zone pump module, the portion of the overall pump energy allocated to the internal zones may be slightly more or slightly less than would be used by the main loop circulation pump used by the prior chilled-beam system. If a low cost, constant speed pump is used with a conventional motor (i.e., low pump efficiency) the pump energy may be higher. If a variable speed pump is utilized, however, that employs an ECM motor, the pump energy may be less.

In one example, the zone pump module (e.g., 100) approach actually reduces the installed cost by an estimated $45,480. This represents a very significant cost savings equating to approximately $3/square foot of the conditioned zones used for this analysis. Further, this approach offers significant pump energy savings over time. Even further, by integrating a modular design approach and allowing for the possibility of factory testing of the zone pump module, potential problems associated with field installation errors and sizing mistakes can be avoided, which offer additional construction savings. Moreover, the zone pump module, in various embodiments, can allow for the ability to provide advanced control capabilities including active condensation control, capacity boost for heating and cooling, variable water flow and capacity control on a zone by zone basis, remote alarm capabilities, active communications with the primary air handling system, and compatibility with variable air flow designs. All of which can be provided, in certain embodiments, while still significantly reducing the cost of installation when compared to the current state-of-the-art design approach.

Further, in a number of embodiments, the zone pump module (e.g., 100) allows for the use of a wider range of chilled or hot water temperatures with the chilled beams (e.g., 170) since the device pulls only the amount of water needed from the main loop (e.g., 340 or 350) then mixes it with return water within the chilled beam to deliver a carefully controlled water temperature (e.g., appropriate for operation) to the beams, for instance, for either heating or cooling. In this way, the zone pump module, in these embodiments, among other things, completely solves the problem of needing separate chilled and hot water loops for the primary air handling system and the beam network. Moreover, the zone pump module integration as part of either a 4 pipe design approach (e.g., as shown in FIG. 1) or, for example, of a 2 pipe design approach (e.g., as shown in FIGS. 2 and 3), allows for a significant reduction in the required water flow, pipe size, and thereby costs associated with the installation for the main water loop (e.g., 343, 353, or both). In one example, a relatively small building block consisting of 14 classrooms served by chilled beams would cost an estimated $45,480 less using the zone pump module described (e.g., 100) than the prior art approach. This equates to savings of approximately $3/square foot of facility from the mechanical equipment budget allowing chilled beams to have an installed cost competitive with more conventional VAV or fan coil design approach while providing substantial operational energy savings.

Furthermore, the embodiment described allows for the delivery of much colder and hotter water to the chilled beams than possible when using the prior art design approach. For instance, 45 degree water can be delivered to the zone pump module (e.g., 100) which then produces the 58 degree water required by the beams (e.g., 170) to produce the 64 degree return water that is returned back to the cooling water loop (e.g., 103 shown in FIG. 1). If a 4 pipe distribution system (e.g., shown in FIG. 1) is chosen for combination with the zone pump module (e.g., 100), the temperature rise across the cooling water loop (delta T) may be around 19 degrees. If a 2 pipe distribution (e.g., as shown in FIGS. 2 and 3) is used with the zone pump module (e.g., 100), then the end of the chilled water loop temperature (e.g., at pump 341 shown in FIG. 3) may be controlled to about 55 degrees so that the loop delta T would be limited to about 10 degrees F. In contrast, the prior art design delivers water at approximately 58 degree F. directly to the beams via the main cooling water loop to avoid the risk of condensation. The same 64 degree water is returned, resulting in a water temperature drop across the main loop of only 6 degrees. The 315% increase (19 vs. 6) in the chilled water temperature change across the main cooling loop possible with the zone pump module and 4 pipe approach and the 166% increase (10 vs. 6) possible with the zone pump module and 2 pipe approach results, in particular embodiments, in improved chiller (e.g., 342) operation and increased system (e.g., 300) efficiency.

Additionally, the zone pump module integration, in particular embodiments, as part of either a 4 pipe design approach (e.g., as shown in FIG. 1) or a 2 pipe design approach (e.g., as shown in FIGS. 2 and 3), allows for all coil passes within the chilled beam (e.g., 170) to be used for either cooling or heating since the zone pump module (e.g., 100), in various embodiments, automatically distributes either chilled or hot water to all beam passes as needed. This can be advantageous since a greater number of passes for either cooling or heating increases the output end energy efficiency of the beam. As discussed, this increased capacity can allow for a shorter beam (e.g., 170) to be utilized when compared to a 4 pipe beam using some passes for heating and others for cooling. Alternatively, it can allow a lower water flow (e.g., from pump 160) to be delivered to the coil to provide the desired output. Another advantage that certain zone pump modules provide is that the potential heating output is greatly increased over a traditional 4 pipe chilled beam coil design that, for example, allocates only two passes for heating and six passes for cooling. There are many applications located in markets that have relatively cold climates that need far more heating capacity that can be provided by only two passes through the coil. If an additional two passes are allocated to heating in an attempt to address this shortfall, only 4 passes are left for cooling and this may not be enough to provide effective cooling operation. By allowing all 8 coil passes, for example, to be used for either heating or cooling (e.g., in chilled beam 170), this capacity problem is resolved, in a number of embodiments, and the maximum heating and cooling output can be delivered by that chilled beam coil.

Still further, most designers are drawn to the possibility of employing chilled beams (e.g., 170) due to the potential for substantial energy savings over that possible with other conventional HVAC systems. Energy and Green Building certification programs like LEED have been instrumental in the growing application of chilled-beam systems in the US. Further, as the system becomes more energy efficient, the percentage of the total energy consumed by the HVAC system that is attributed to the water pumps increases. In many instances, the pump energy is on par with the total heating energy and accounts for approximately 25% of the total HVAC energy used. As a result, it would be beneficial to have a pumping system for chilled-beam systems that minimizes the energy used for pumping water during both peak and part load conditions. The zone pump module (e.g., 100), in a number of embodiments, allows for a very substantial reduction (up to approximately 90%, in certain embodiments) in the pump energy that would be used by a chilled-beam system that simply cycles a pump or control valve on and off to modulate the cooling and/or heating output from the chilled beams. This significant energy savings results from the ability to modulate the amount of water flow that can be provided to each zone locally, depending upon the cooling or heating load in the zone at any moment in time. The modulation can be accomplished, in some embodiments, by utilizing a pump (e.g., 160, 316, 326, or 336) with various speed steps that can be remotely selected by a controller (e.g., 190, 3190, 3290, 3390, or 390) to increase or decrease water flow as needed by the system. An efficient example is a fully modulating variable speed pump, which may include a high efficiency pump that utilizes an ECM motor, for instance.

To highlight the substantial energy savings potential, three embodiments were compared. The baseline system is assumed to cycle a local pump (e.g., 160) on and off as needed to satisfy the cooling load within the sample space. This pump in this example is a constant speed pump operating at full flow whenever energized. The second approach assumes the use of a multi-speed pump (e.g., 160), having a traditional pump efficiency (in this case considered to be 20% overall operating efficiency) that is modulated to provide one half of full flow when approximately 80% of peak cooling power from the coil within the beam (e.g., 170) is needed. This magnitude of the potential for energy savings was not fully appreciated, nor obvious, until substantial laboratory testing of the zone pump module (e.g., 100) connected to chilled beams (e.g., 170) was completed and analyzed. It was discovered that the water flow through a high capacity chilled beam (e.g., 170) could be reduced in half (say from 1.5 gallons per minute to 0.75 gallons per minute) while still delivering approximately 80% of the cooling output provided at full flow. Since the cooling output from the beam is non-linear with respect to flow, with a high percentage of the potential coil cooling output being delivered even with a substantial reduction in flow (e.g., 50%), the ability to recognize large pump energy savings (e.g., from pump 160) through the modulation of pump speed and thereby water flow at part load conditions was discovered. Since at 50% flow reduction, energy consumption can be reduced by approximately 75%, there is little incentive to reduce flow further, so a pump (e.g., 160) with only several operating speeds can provide most of the potential pump energy savings benefits. In certain embodiments, more benefit may be recognized by utilizing a true variable speed pump (e.g., for pump 160) that is driven by a high efficiency (e.g., ECM) motor. In this way, the full functionality of the flow control can be recognized while simultaneously benefiting from the significant increase in overall pump energy efficiency—going from approximately 20% to as high as 60% with the ECM motor.

Employing a variable-flow zone pump (e.g., 160, 316, 326, or 336) may be particularly beneficial when it is coupled with a control system (e.g., including controller 190, 3190, 3290, or 3393) that has been fitted with control logic capability of effectively determining when the pump speed should be modulated or cycled to satisfy the space cooling/heating needs and when it should be modulated to reduce energy consumption. Feedback from the space temperature sensor (e.g., 195, 3195, 3295, or 3395), combination temperature and humidity sensor (e.g., combined with sensor 199, 3199, 3299, or 3399), the supply water temperature sensor (e.g., 175, 3175, 3275, or 3375), and desired set point, condensation sensor, occupancy sensor, unoccupied temperature set point and other inputs may all impact the pump speed or water flow chosen at any point in time. These decisions may be made by the controller component of the zone pump module (e.g., 190, 3190, 3290, or 3390) in a number of embodiments, or by a central controller (e.g., 390), as another example. As previously discussed, in various embodiments, the zone pumps (e.g., 160, 316, 326, or 336) may be controlled, in a number of embodiments, so the flow does not drop below a level at which the pressure loss across the (e.g., pressure regulation) device (e.g., 180, 3180, 3280, or 3380) is inadequate to allow the appropriate amount of chilled or hot water to enter the zone pump module in order to deliver the desired supply beam water temperature.

One of the main barriers to acceptance and application of the chilled-beam technology outside of the "dry" northern European climates is the concern for condensation on the chilled beam coil surface. This is a serious and legitimate concern since these devices may be installed in the ceiling space of occupied buildings, located over individuals, equipment and furnishings. If the water temperature delivered to the beams is low enough or the space humidity high enough for the air entering the coil to reach the saturation dew point at the coil surface, condensation may occur. Due to this risk, which can be quite high from the prospective of a design engineer, and the ineffective solutions offered by the prior art beam technologies, chilled-beam systems have often been ignored as a viable design option despite the substantial energy savings potential offered. As discussed previously, the prior art approach to addressing condensation control involves turning off the water to the beams when a condensation sensor is tripped. There are two major problems with this approach. First, this type of condensation sensor has been found to be unreliable, often providing false condensation signals that stops all cooling to the space during inconvenient times, causing some users to bypass this safety function. Secondly, it is considered a serious disadvantage to have a system that results in the loss of all cooling when the condensate sensor is activated. There is a strong need or potential for benefit, in many applications, to continue the supply of effective cooling while actively modulating the chilled beam cooling system to ensure that condensation does not occur.

Previously, some advanced control systems have been offered to the marketplace that sense the zone temperature and dew point conditions, then use a zone pump in combination with a three way control valve to raise the chilled water temperature supplied to the beams as needed to avoid condensing conditions. If done effectively, this solves the problem of eliminating all cooling. As the chilled water supply temperature is increased, however, a significant reduction in the cooling output occurs. For example, a reduction of approximately 20% to 30% in the coil cooling power would be typical if the chilled water supply temperature is increased by just 4 degrees F. It would be advantageous to better maintain the peak cooling output from the beams during times of potential condensation since it will be most common to encounter condensation conditions when sensible loads within the space, or even peak sensible loads within the space, also exist. Examples of such times include cases where zones are over-crowed (e.g., classrooms) with occupants such that both the latent load (humidity) and sensible loads (temperature) are greater than design. Another example includes days were it is both warm and raining outdoors. Yet another example is when a window or door is left ajar when the outdoor air conditions are both hot and humid.

In a number of embodiments, the zone pump module (e.g., 100) has the capability of addressing both of these problems by simultaneously responding to potential condensing conditions while also delivering a chilled beam coil cooling power output that is at or near the design maximum, or at least as high as possible under the circumstances. To accomplish this, in certain embodiments, the zone temperature and humidity sensors (e.g., 195 and 199, 3195 and 3199, 3295 and 3299, or 3395 and 3399) feed data to the zone pump module controller (e.g., 190, 3190, 3290, or 3390), or the central controller (e.g., 390) where the space dew point is calculated, for example, at any moment in time. This value is then compared, in various embodiments, with the chilled water temperature (e.g., measured by sensor 175, 3175, 3275, or 3375) delivered to the chilled beam or beams (e.g., 170, 311, 321, or 331) serving the zone and leaving the zone pump module. The water temperature leaving the zone pump module is controlled, in a number of embodiments, by the supply water set point. This set point may be a predetermined input to the control logic, in certain embodiments, for example, based on the design space loads, but may be automatically resettable within the program by the program logic, for example, to account for scenarios including condensation control, boost mode, heating/cooling change over, other situations, or a combination thereof.

In a number of embodiments, if the measured or calculated room or zone dew point rises to within 1 to 2 degrees F. (the pre-determined dead band, in this example, reflecting the accuracy of the temperature/humidity sensors used) of the supply water temperature, the supply water temperature set point is incrementally reset. This is accomplished, in certain embodiments, by a PID loop (proportional/integral/derivative), for example, within the control logic, to maintain the cooling supply water temperature above the actual room or zone dew point, for instance, by the predetermined dead band value. In this manner, active condensation control is initiated, in various embodiments, without eliminating cooling of the space or zone. As the cooling supply water temperature delivered to the beams is increased to avoid condensation, however, the amount of cooling output from the beam decreases. As previously mentioned, there are many reasons why it is advantageous to offset this reduction in cooling while simultaneously avoiding condensation. This is accomplished by certain embodiments of the zone pump module in the following manner.

In particular embodiments, as the supply water temperature is incrementally increased (e.g., at water temperature sensor 175, 3175, 3275, or 3375) to avoid condensing conditions, the space temperature sensor (e.g., 195, 3195, 3295, or 3395) is simultaneously monitored. If the space temperature is determined to be above the cooling set point (e.g., additional cooling is required), for example, as a result of the increased cooling supply water temperature, then a second PID loop, for instance, controlling the variable speed pump (or pump with incremental speed settings) (e.g., 160, 316, 326, or 336) increases the water flow, for instance, incrementally, until either the space conditions are satisfied or the pump reaches its maximum speed, flow, pressure limit, or preset maximum allowable setting, as examples. If the maximum water flow conditions are met, for example, and the space temperature conditions are still not satisfied using the minimum cooling supply water temperature allowed by the active condensation control logic, in particular embodiments, an alarm is sent to the main building automation system (BAS).

As an example, consider an over-crowded classroom where both the sensible and latent loads are elevated. The initial supply water set point (e.g., at first or water temperature sensor 175, 3175, 3275, or 3375) is 57 degrees F. and the space dew point starts at 55 degrees F. (e.g., measured at or calculated from a measurement from humidity sensor 199, 3199, 3299, or 3399). The cooling output needed from each chilled beam (e.g., 170, 311, 321, or 331) coil to satisfy the space sensible load is assumed to be 3560 BTU/hr. This coil cooling power output is achieved using 0.75 gallons per minute of the 57 degree water delivered by the zone pump module (e.g., module 100, this flow occurring through pump 160, 316, 326, or 336, for instance). The increased latent load in the space is assumed to cause the space dew point to rise from the original 55 degrees to 58 degrees. In this example, a two degree F. dead-band is used between the supply water reset and the measured space dew point temperature by the active condensation control logic (e.g., in controller 190, 3190, 3290, or 3390).

Based on the conditions of this example, in various embodiments, the zone pump module (e.g., 100, or controller 190, shown in FIG. 1) responds to the increase in space dew point (e.g., measured at sensor 199) and avoids beam condensation by raising the cooling supply water set point (e.g., for the location measured by water temperature sensor 175) from the initial setting of 57 degrees to 60 degrees to account for the increase in the actual space dew point from 55 degrees to 58 degrees plus the assumed 2 degree dead-band. In this example, increasing the beam supply water temperature from 57 degrees to 60 degrees results in a reduction in the beam coil cooling power output from the initial level of 3568 BTU/hr to only 2870 BTU/hr. Since the space load remains high in our example, this reduction in cooling capacity causes the space temperature (e.g., as measured by second or zone temperature sensor 195) to begin to rise above set point. In response to this rise in space temperature, in particular embodiments, the zone pump module (e.g., 100, or controller 190) responds by incrementally increasing the chilled beam supply water flow rate from the initial 0.75 gallons per minute to 1.25 gallons per minute at the higher 60 degrees F. This is accomplished by increasing the speed of the zone pump (e.g., 160). By increasing the flow, the required coil cooling output of 3552 BTU/hr is achieved despite the 3 degree rise in supply water temperature.

In other embodiments, if high-accuracy space temperature and humidity sensors are utilized (e.g., 195 and 199 respectively), for example, then the dew point dead-band can be decreased to 1 degree. This would allow the desired cooling output to be achieved with 59 degree water requiring only 1.1 gallon per minute of chilled water flow. In this manner, for either type sensor, a very significant benefit is provided by this particular embodiment of the zone pump module (e.g., 100) since both the avoidance of condensation and the maximum cooling output possible from the coils (e.g., chilled beam or beams 170), under the circumstances, are achieved. As previously discussed, this capability is facilitated, in this embodiment, by both the (e.g., pressure reduction) device (e.g., 180) and (e.g., variable speed) pump (e.g., 160) being properly selected and set based upon various project/zone specific design parameters.

Another significant barrier to the acceptance and application of the chilled-beam technology is the concern regarding flexibility of cooling and heating output as loads vary and/or to accommodate for miscalculations in initial load estimates or inefficient installation. With prior art chilled beam designs, peak cooling and heating loads are estimated. Based on these estimates, a number of beams of a given length, a primary airflow, a supply water temperature, and a water flow can be selected for each zone. At peak conditions, the flow is provided continuously, and at part load conditions, the water flow is cycled on an off. The amount of water flow to each zone is limited by the capacity of the main loop pump (e.g., analogous to 341 or 351 shown in FIG. 3) so the flow to an individual zone is not easily increased. Likewise, the water temperature to all zones is the same.

In contrast, with various embodiments of the zone pump module (e.g., 100) described herein, since the water flow and temperature can be varied zone by zone, far more flexibility to accommodate variations in load conditions is provided. This can be an advantage over the prior state-of-the-art system. For example, in particular embodiments, a subset of the same control logic used to provide active condensation control can be used to offer an effective "boost" mode for cooling, heating, or both. It is common that the greatest need for space cooling occurs when the outdoor air is hot and sunny. As a result, the heat gain through the building envelope is greatest at the same time that the solar load entering through windows is at its maximum. A review of actual hour by hour weather data or the ASHRAE Fundamentals Handbook (where peak sensible and peak latent design conditions are shown separately) confirms that the peak sensible load is seldom coincident with the peak humidity conditions. This results in the space dew point conditions generally being at less than peak design, due to the fact that the infiltration air does not have the maximum absolute humidity content. Therefore, at times when the sensible load is at its peak—when the most cooling output is needed from the chilled beams—the space dew point will often be below its design maximum.

In a number of embodiments, the zone pump module (e.g., 100 shown in FIG. 1) can take full advantage of such conditions by using the feedback from the zone temperature (e.g., 195) and humidity (e.g., 199) sensors, on a zone by zone basis, to reset the chilled water temperature delivered to the chilled beams downward, to increase the water flow, or both. In this way the zone pump module, in some embodiments, takes advantage of the off peak space latent load (reduced space dew point) to provide greater cooling output to the space. For example, consider a classroom located on the sunny side of the building with significant glass. The outdoor ambient temperature is very high, in this example, yet the absolute humidity level is moderate. The initial beam supply water temperature set point is 58 degrees F. (e.g., measured at sensor 175) and the design water flow is 1 gallon per minute. These conditions provide a coil cooling power output from each beam of 3650 BTU/hr. On this extreme day, however, the solar load has taxed the cooling capacity at these settings and, as a result, the space temperature begins to exceed the room thermostat (e.g., digital controller 190, zone temperature sensor 195, or both) set point condition. The increase in space temperature combined with the heavy solar load (sunshine through the windows) makes the occupants uncomfortable. In response, the teacher lowers the space set point temperature by 1 degrees F., from 75 to 74 degree F., requiring that additional cooling BTUs be removed from the space. Since the outdoor air absolute humidity is well below its peak conditions, however, the space is at an off-peak dew point of 55 degrees F.

Based on the conditions of this example, in certain embodiments, the zone pump module (e.g., 100, or controller 190) responds to the need for increased cooling capacity at the reduced space dew point by first dropping the cooling supply water set point from the initial setting of 58 degrees to 57 degrees to take advantage of the moderate space dew point of 55 degrees while maintaining the 2 degree deadband between the supply water temperature (e.g., at sensor 175) and the measured space dew point (e.g., measured at zone humidistat 199 or calculated from a measurement therefrom) of this example. In this example, decreasing the chilled beam supply water temperature from 58 degrees to 57 degrees, while maintaining the same 1 gallon per minute chilled water flow rate, increases the beam (e.g., 170) coil cooling power output from 3650 BTU/hr to 3893 BTU/hr. In a number of embodiments, the zone pump module (e.g., 100, or controller 190 using space temperature sensor 195) continuously monitors the space temperature to determine if this capacity increase is adequate to reach the desired space temperature set point. Since this example assumes that the space temperature set point is lowered 1 degree by the occupants, it is possible that this 7% increase would not be adequate to satisfy the new space set point condition (e.g., at all or within a sufficient amount of time).

If the zone temperature remains above the new 74 degree set point despite the increased beam cooling capacity provided by the reduction in supply water temperature, in this particular example, and in certain embodiments, the zone pump module (e.g., 100, or controller 190) responds by increasing the chilled beam supply water flow rate from the initial 1 gallon per minute to 1.25 gallons per minute, (e.g., incrementally and as determined by a PID loop, in various embodiments) to increase the cooling capacity further, to 4125 BTU/hr., in this example, a 13% increase over the original design coil cooling or chilled beam output. If this increase is not adequate to satisfy the new zone or space thermostat set point, in this example, in a number of embodiments, the water flow is increased further by the zone pump module to, for example, 1.5 gallons per minute where the cooling output is increased to 4306 BTU/hr, an increase of 18% over the original design coil cooling output.

If multiple zones (e.g., 310, 320, and 330 shown in FIG. 3) are operated in this manner, data provided to the main BAS system or control panel (e.g., central controller 390) feeding the primary air handling system or DOAS (e.g., 360) feeding the chilled beams (e.g., 311, 321, and 330) is used, in certain embodiments, to determine if the temperature of the air feeding the beams (e.g., exiting heat exchanger 366) should be reset to a lower temperature. By "polling" all of the zone pump module data (e.g., from controllers 3190, 3290, and 3390), for example, a better or the optimum supply air temperature (e.g., exiting heat exchanger 366) may be determined and, if appropriate, additional space cooling can be provided in this manner in particular embodiments. Also, if the space set point cannot be achieved after both the water temperature and flow are improved or optimized, in particular embodiments, an alarm is sent to the main BAS system to alert the building engineer of a potential problem with the cooling system or space (e.g., opened door or window).

There may also be a significant benefit, in many applications, associated with the ability to operate in a heating season boost mode, and a number of embodiments include such an ability. As discussed previously, the heating capacity required by a given zone can often be satisfied at a reduced water flow (e.g., one half) when compared to that needed for cooling. To provide for pump energy savings, in a number of embodiments, the zone pump module (e.g., 100) automatically operates the heating water flow at this lower level (e.g., by reducing the speed of zone pump 160) when variable or staged flow capability is used. Similar to cooling, however, if a reduced, unoccupied zone temperature setting is used, a heating boost may be beneficial, in some embodiments, to reach the occupied temperature set point in a timely manner. Further, on extremely cold days, more heating output may be required. In such cases, certain embodiments of the zone pump module (e.g., 100) can respond to the need for more heating output by increasing the water temperature delivered to the beams, by increasing the water flow, or both, for example, in a manner similar to that described for the cooling mode.

Various scenarios exist where the capacity boost mode can be beneficial. One such case, in a number of embodiments, is where both occupied and unoccupied space temperature set points are used. In such cases, there may be a desire to change to the space occupied set point just before the occupants reach the facility. In such cases, a boost to the cooling or heating capacity output may be helpful to bring the space temperature to the new, occupied set point in a timely manner. Various embodiments include such a feature. Another example is where, after occupancy, it is discovered that the actual cooling load within a given space is greater than the design values estimated. This could occur, for example, due to a design error, a change of use for the space, increased occupancy, or for other reasons. In a number of embodiments, the zone pump module (e.g., 100) provides the flexibility to either increase the design water flow (e.g., by increasing the speed of zone pump 160) or decrease or increase the water temperature in the beam or beams within the zone without having to impact the adjacent zones or the main water loop temperature or pump (e.g., 341 or 351 shown in FIG. 3) capacity. This is not the case with prior art chilled-beam systems.

Some embodiments can reduce or minimize the primary airflow fan energy (e.g., from fan 364 shown in FIG. 3) associated with chilled-beam systems. Consequently, variable primary airflows may be provided, in some embodiments, for example, in combination with heating and cooling modulation via the chilled beams (e.g., 311, 321, and 331). Reasons for doing so along with the limitations and problems associated with the prior art chilled-beam system design have been previously discussed. In certain embodiments, the zone pump module solves these problems and accommodates variable airflow designs by providing for effective modulation of cooling or heating output (or both), for instance, while simultaneously avoiding the risk of beam condensation due to the active condensation control capability. In particular embodiments, outdoor air fan 364 can be a multiple-speed or variable-speed fan, for example, and the speed of fan 364 can be controlled by central controller 390, for instance, to provide the minimum outdoor air flow required to meet the zone with the greatest need for outdoor air.

In this example, we look at a simplified version of a typical classroom during unoccupied periods with the primary airflow (e.g., from fan 364 shown in FIG. 3) reduced to 50% of the peak design value. The classroom is designed for 26 occupants, uses high efficiency lighting at 1.25 watts per square foot, and is a single story structure with windows. We assume that 390 cfm of outdoor/primary air is delivered to the classroom during occupancy, (e.g., from fan 364) and during unoccupied periods, this primary airflow is cut to only 195 cfm. This reduces both the cooling associated with the primary air and, as importantly, cuts the space dehumidification (all done with the primary air) in half. The primary supply air temperature is 65 degrees and the room design temperature is 75 degrees in this example.

In this example, with no occupants in the space, no lights operating and an 80% reduction in the envelope/solar load, the chilled beam coil capacity required is reduced to 6,190 BTUs from 15,773 BTUs when fully occupied and at peak load conditions. The advantages offered by the zone pump module, in this example, in a number of embodiments, include a reduction in the primary airflow from 390 cfm to 195 cfm (a 50% reduction). There is little incentive to reduce the primary airflow below this 50% reduction since doing so reduces the fan energy used by the DOAS systems serving the beams by more than 80% (or 95% of that typically used by a traditional VAV or fan coil system at peak conditions). Further, as the primary airflow to the beam is reduced, in this example, so is the air pressure within the chilled beam. The reduction in beam pressure from 0.7" to 0.2" associated with the reduction in airflow also reduces the coil cooling power output. With the prior art approach, however, the beam output is still far greater than required by the space once the people, lighting and a portion of the envelope/solar load is removed. As a result, the prior art approach operates at the same full water flow conditions and cycles the flow on and off, operating 60% of the time to match the zone load conditions. This reduces the pump energy by 41% when compared to the peak occupied mode when the water is assumed to be provided to the zone continuously to satisfy the load conditions. Since the prior art supply water temperature remains the same as during the occupied mode (57 degrees), while the dehumidification delivered by the DOAS is cut in half, the risk for condensation on the coils may be increased significantly depending upon the moisture introduced to the building by infiltration, door openings, leaks, etc.

The control flexibility associated with various embodiments of the zone pump module (e.g., 100), however, allows the water flow rate to be significantly reduced (e.g., 1.25 gpm to 0.75 gpm) while simultaneously raising the supply water temperature to deliver the desired space cooling. Reducing the water flow provides a substantial pump energy savings (e.g., for pump 316, 326, or 336), using only 37% of that used by the current prior art style approach (e.g., 0.0059 HP vs. 0.0016 HP per zone). Further, the increased supply water temperature (60 degrees vs. 57 degrees) provides a comfortable buffer between the allowable space dew point and the supply water temperature, in a number of embodiments, making beam condensation highly unlikely even with a 50% reduction in dehumidification capacity associated with the primary airflow.

In another example, we consider what happens, in certain embodiments, when the primary airflow is varied (e.g., by dampers 361, 362, and 363, shown in FIG. 3) on a zone by zone basis, for example, CO2 demand control ventilation, when occupancy is reduced throughout the day. For this example, we look at a similar zone as used above, but assume that there is a lone teacher in the classroom grading papers. In this case, most of the sensible load associated with the occupants is removed but the lighting load and the peak envelope/solar load remains. In this example, a different problem is identified that can also be addressed by certain embodiments of the zone pump module (e.g., 100 shown in FIG. 1). With the prior art mode, the reduction in cooling capacity associated with the lower primary airflow is much greater than desired, resulting in a significant shortfall in coil cooling power (e.g., 10,240 BTU provided vs. 11,629 BTU needed). Since the water flow and temperature are fixed, in the prior art, the space conditions cannot be met with this methodology. In contrast, the zone pump module (e.g., 100), in certain embodiments, can respond to the need for additional cooling. The zone pump module, in this example, in various embodiments, allows the chilled water flow to the beams in the zone to be increased slightly, for example, from 1.25 gpm to 1.5 gpm, while also dropping the supply air temperature, for instance, from 57 degrees to 56 degrees. In this way, the coil cooling power output from the beams with reduced primary airflow is increased to 11,640 BTUs from 10,240 BTUs and, in this manner, satisfies the cooling needs of the space in this example. In this example, reducing the chilled water temperature by one degree is done with little risk of reaching condensation on the beams since, in addition to the greatly reduced latent load associated with the occupants, the surrounding zones are occupied and well conditioned so any latent load associated with infiltration or door openings would be expected to be modest. Further, there are many additional VAV system configurations for active and passive chilled beams. The examples here are only some of many ways that a zone pump module can modulate water flow and water temperature, for example, to optimize pump energy and cooling capacity while minimizing the risk of beam condensation.

There are many beneficial uses for the information that is measured locally, at each zone, by certain embodiments of the zone pump module. For example, knowing the dew point and temperature at each zone, in particular embodiments, allows polling communications with either the building BAS system or directly with the main controller (e.g., central controller 390 shown in FIG. 3) serving the primary air system (DOAS) (e.g., 360). Knowing this information for all zones, for example, can allow for an optimization, for instance, of the supply air dew point or the primary air temperature leaving the DOAS and delivered to the chilled beam network (or both). At times when all zones (e.g., 310, 320, and 330) are maintained well below the desired space dew point, in a number of embodiments, significant energy savings can be recognized by raising the primary air dew point setting (e.g., delivered by system 360). Conversely, if multiple zones are approaching condensation alarms, then, in particular embodiments, drier air can be requested (e.g., by central controller 390) from the DOAS (e.g., 360) to avoid this problem.

During extreme cooling conditions, when more cooling is needed and humidity control is not a challenge, in a number of embodiments, a cooler temperature can be requested (e.g., by controller 390) from the DOAS (e.g., 360) to support the cooling output from the chilled beams (e.g., 311, 321, 331, or a combination thereof). This may be done, in some embodiments, in response to a further need for cooling once the zone pump module (e.g., as controlled by controllers 3190, 3290, or 3390) has improved or optimized the chilled water flow and temperature delivered to the beams. In various embodiments, the zone pump module or it's controller can include or receive information from a CO2 sensor, motion detector, or other style occupancy switch to confirm occupancy of an individual zone, as examples. In addition to using this information locally (e.g., by controller 3190, 3290, or 3390, as appropriate), in certain embodiments, the zone pump module can pole this information to the DOAS system (e.g., to controller 390) to determine the percentage or quantity of outdoor air that should be processed by the DOAS system (e.g., 360). Further, in a number of embodiments, the zone pump module (e.g., controller 3190, 3290, or 3390) or the central controller (e.g., 390) can drive the VAV box serving the zone (e.g., dampers 361, 362, or 363) to vary the amount of primary air delivered to the space (e.g., zone 310, 320, or 330, respectively) based on occupancy, for example, while ensuring, in a number of embodiments, the minimum flow required for proper beam function and space dehumidification. In addition, a wide array of valuable alarm functions are also available, in particular embodiments, for example, to notify the building manager of potential problems ranging from potential condensing conditions to low (or high) end-of-loop (e.g., 343 or 353) water temperature.

Further, the modular "plug and play" design of certain embodiments of the zone pump module (e.g., 100), which integrates the control valves (e.g., 191 and 192, in the embodiment shown), pump (e.g., 160), (e.g., flow measurement) device (e.g., 180), wiring, sensors (e.g., 175, 195, and 199), controls (e.g., 190) and other key components into a single unit (e.g., module 100) that can be factory built and tested, may greatly simplify and reduce the cost of the overall chilled-beam system installation. Further, avoiding custom programming by the local controls contractor, in a number of embodiments, reduces the likelihood of errors while reducing the cost to the owner.

The piping connections to and from the zone pump module (e.g., 100 shown in FIG. 1) may be done, in a number of embodiments, using quick-connecting flexible tubing within each zone so the installation piping can be done both efficiently and cost effectively as a result of the zone pump module. Further, in various embodiments, the ability to use almost any common chilled and/or hot water temperature, or a wider range of such temperatures in comparison with the prior art, simplifies the piping external to the zones (main water loops, e.g., 343 and 353 shown in FIG. 3) and, as previously outlined, greatly reduces the installation cost. Moreover, in certain embodiments, the controller (e.g., 190) that can be integrated within the zone pump module (e.g., 100) may be capable of communicating with one or more other BAS networks, and open protocol networks like BacNet, central controller 390, or a combination thereof. In this way, the zone controller (e.g., 190) can pass along information obtained locally at each zone, and allow access to all of the sensors (e.g., 175, 195, 199, or a combination thereof), for example, by the building BAS or DOAS controller (e.g., 390), for instance, in some embodiments, via a simple data cable daisy-chained to all zone pump modules which, in many embodiments, can be done simply and inexpensively.

To take full advantage of the many benefits offered by certain embodiments of the zone pump module (e.g., 100), comprehensive and complex control logic may be utilized (e.g., in controller 190, 3190, 3290, 3390, 390, or a combination thereof). Certain embodiments, for example, are configured to have variable speed pumping capability, performance boost mode, and active condensation control. In a number of embodiments, determining all of the appropriate steps and sub-steps required for proper operation of the zone pump module, as well as the decision points (e.g., sequencing of functions or PID loop logic) can properly be made with laboratory testing of the device (e.g., module 100). For example, minimum and maximum flow parameters can be set. In a number of embodiments, if the minimum flow (e.g., of pump 160 shown in FIG. 1) is reduced too low, and there is insufficient pressure across the (e.g., pressure regulating) device (e.g., 180), it may not be possible to reach the desired supply water heating or cooling set points and proper zone conditioning will not be accomplished. Further, allowing pump (e.g., 160) flow to increase too significantly, in some embodiments, can result in noise and inefficient operation. Such factors should be taken into consideration in the configuration of a number of embodiments.

Moreover, in some embodiments, it can be beneficial to set up the pump (e.g., 160) for a reduced flow at peak design conditions in the heating mode compared to the cooling mode. In a number of embodiments, doing so offers significant energy savings in the heating mode. Further, since the heating water flow is already low, it may be best, in some embodiments, to first modulate the heating supply water temperature to respond to changes in load. Then, once temperature modulation reaches certain predetermined limits, water flow can be increased to boost the heating output further, if needed. Conversely, it can be beneficial, in a number of embodiments, to modulate the water flow first, during the cooling mode, rather than water temperature. Since water flow in the cooling mode can initially be set at a much higher flow than in the heating mode, in a number of embodiments, there is more modulation in both cooling power output from the beams and potential pump (e.g., 160) energy savings during the cooling mode. Further, since condensation on the beams (e.g., 170) is often a primary concern in the cooling mode, maintaining the water temperature relatively elevated (e.g., at sensor 175) and reducing it only during peak times when a boost is needed may be prudent in certain embodiments.

Some embodiments respond to a significant drop in cooling or heating output due to lower primary airflow rates and therefore beam pressures during low occupancy conditions when VAV primary air systems are employed. Further, various embodiments include an effective active condensation prevention mode that allows for continued, effective conditioning of the zone as it adjusts system parameters to avoid beam condensation. In a number of embodiments, thorough, pretested control logic can be incorporated into the controller (e.g., 190, 3190, 3290, or 3390) serving the zone pump module (e.g., 100). In some embodiments, the controller serving the zone pump module (e.g., 190, 3190, 3290, or 3390) can be installed remotely from the zone or zone pump module (e.g., 100), for example, such as within central controller 390 shown in FIG. 3 or within the main BAS system, for example, and then communicated to an expander board located in or near the zone or zone pump module (e.g., 100). In many embodiments, however, the logic may be included within a controller (e.g., 190, 3190, 3290, or 3390) mounted integral to the zone or the zone pump module, as other examples. Integrating the logic controller within the zone pump module can allow all of the wiring to be completed within the factory, in some embodiments, and the device (e.g., module 100) fully tested prior to shipment to the site. As mentioned, this can reduce the cost to the owner while eliminating installation problems in the field, in a number of embodiments.

Further, in a number of embodiments, having the control logic imbedded locally within the zone pump module (e.g., 100, for instance, in zone controller 190, 3190, 3290, or 3390) allows parameters to be preset in the factory that are unique to a given zone or project. For example, some zone pump module devices (e.g., 100) might be serving 4 beams while others might be serving 6 beams. As a result, the minimum and maximum flow settings might be different for each zone pump module (e.g., 100). In another instance, some zones might utilize variable speed pumps (e.g., 160) while others might be well served by a constant speed pump (e.g., 160) and the code (e.g., within controller 190) could be modified accordingly before shipment. Yet in another case, there might be a desire to communicate the conditions measured by the zone pump module (e.g., 100 or controller 190) to the BAS or the control module (e.g., 390 shown in FIG. 3) serving the DOAS system (e.g., 360). To do so, there may be, for example, an IP address assigned to each module (e.g., 100) that is known by the control module (e.g., 390) in the DOAS system, for instance. This can be done in the factory, in a number of embodiments, and communications can be tested prior to shipment to the jobsite. This is just a sampling of many benefits offered by an integrated controller (e.g., 190, 3190, 3290, 3390, or a combination thereof).

It should be understood that the sample logic described herein is only one example of many potential control schemes. In some instances, the logic could be more complex and in other instances it could be much simpler. For example, some embodiments use a constant speed pump, do not employ a zone RH sensor (e.g., 199), so there is no active humidity control capability, use a commercially available room controller (e.g., 190) to send a signal to the control valves (e.g., 191 and 192) while deciding between heating and cooling mode, or a combination thereof. While much simpler than an example of zone pump module that includes advanced features (e.g., described herein), this approach might be appropriate for climates where humidity conditions are low, beam condensation is less of an issue, and where both heating and cooling loads are modest due to favorable climatic conditions. Even with a simplified system, however, the cost savings and pump energy reduction associated with using one chilled water loop (e.g., 343 shown in FIG. 3) for both the DOAS (e.g., 360) and the beams (e.g., 311, 321, and 331), using less primary loop distribution pipe due to the one-pipe design (e.g., shown in FIGS. 2 and 3) for heating and cooling, and using smaller pipe due to the increased water temperature differential (as discussed previously), make the incorporation of the zone pump module (e.g., 100) an effective system design enhancement. Regardless of the control logic employed, the modular "plug and play" design of the zone pump module (e.g., 100), in various embodiments, brings greater simplicity to the chilled-beam system design, installation and commissioning process, one of the most significant barriers to widespread use of this energy efficient technology.

Figure 4:
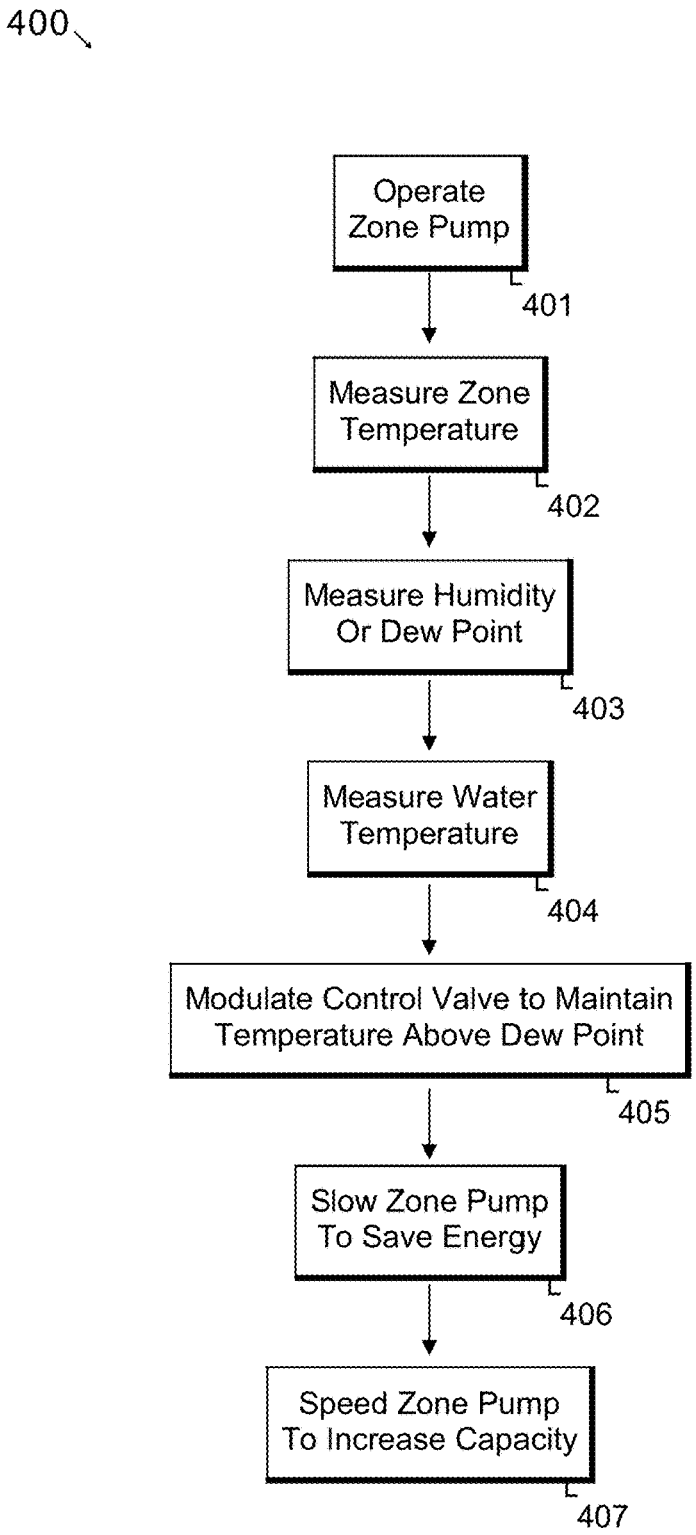
FIG. 4 is a flow chart illustrating an example of a method of controlling at least one chilled beam in a zone of a multi-zone air conditioning system.

Various control schemes and methods have already been described. As a further example, FIG. 4 illustrates a method of controlling at least one chilled beam (e.g., cooled with chilled water) in a zone of a multi-zone air conditioning system, for instance, to reduce energy consumption, increase capacity, or both. In the embodiment shown, method 400 includes act 401 of operating a zone pump. Examples of such zone pumps include pump 160 shown in FIGS. 1 and 2 and zone pumps 316, 326, and 336 shown in FIG. 3. In method 400, the zone pump serves the zone, and in a number of embodiments, both recirculates water through the (e.g., at least one) chilled beam and circulates chilled water from a chilled-water distribution system into the (e.g., at least one) chilled beam. For example (e.g., in act 401), zone pumps 316, 326, and 336, shown in FIG. 3, serve zones 310, 320, and 330, respectively, and recirculate water through (e.g., the at least one) chilled beams 311, 321, and 331, respectively, as well as circulating chilled water from chilled-water distribution system 340 into (e.g., the at least one) chilled beams 311, 321, and 331, respectively.

In the embodiment depicted, method 400 also includes act 402 of measuring zone temperature or space temperature within the zone. Act 402 can be accomplished, for instance, with zone temperature sensor or thermostat 195 shown in FIG. 1 or zone temperature sensors or thermostats 3195, 3295, or 3395, for zones 310, 320, and 330, respectively, shown in FIG. 3. Moreover, method 400 includes, in the embodiment illustrated, act 403 of measuring humidity or dew point within the zone. Act 403 can be accomplished, for instance, with zone humidistat 199 shown in FIG. 1 or zone humidistats 3199, 3299, and 3399, for zones 310, 320, and 330, respectively, as shown in FIG. 3, or a subcombination thereof. Further, as used herein, "measuring humidity or dew point within the zone" includes measuring another parameter from which humidity or dew point can be calculated.

Further, method 400 includes, in the embodiment illustrated, act 404 of measuring the temperature of the water, for example, entering the (e.g., at least one) chilled beam. Act 404 can be accomplished, for instance, with sensor 175 shown in FIGS. 1 and 2 or sensors 3175, 3275, and 3375, for zones 310, 320, and 330, respectively, shown in FIG. 3, or a subcombination thereof, as other examples. In different embodiments, in act 404, water temperature can be measured directly, for example, with a temperature probe that extends into the water, or can be measured indirectly, for instance, by measuring the temperature of the pipe or conduit (e.g., 150) that the water flows through or by measuring the temperature of the chilled beam (e.g., at the inlet to the chilled beam), as other examples.

In the embodiment illustrated, method 400 also includes act 405 of (e.g., automatically) modulating (e.g., at least one) control valve (e.g., a chilled-water control valve) to maintain the temperature (e.g., of the water or of the chilled beam) above the dew point (e.g., measured in act 403 or calculated from the measurement obtained in act 403). Act 405 can be instigated or performed, for example, by a controller, such as controller 190 shown in FIGS. 1 and 2, one or more of zone controllers 3190, 3290, and 3390 shown in FIG. 3, or central controller 390 shown in FIG. 3, as examples. Examples of such control valves include first control valve 191 shown in FIGS. 1 and 2, and valves 319, 329, and 339, for zones 310, 320, and 330, respectively, as shown in FIG. 3. Further, in a number of embodiments, act 405 can include regulating how much water passing through the zone pump (e.g., 160, 316, 326, or 336) is recirculated through the (e.g., at least one) chilled beam (e.g., 170, 311, 321, or 331) and how much of the water passing through the zone pump is circulated (to or) from the (e.g., chilled water) distribution system (e.g., 340). Moreover, in a number of embodiments, act 405 of (e.g., automatically) modulating the (e.g., at least one chilled-water) control valve includes maintaining the temperature (e.g., of the water entering) the (e.g., at least one) chilled beam (e.g., 170, 311, 321, or 331) at least a predetermined temperature differential above the dew point within the zone. This predetermined temperature differential, can be, for instance, 0.25, 0.5, 0.75, 1, 1.25, 1.5, 1.75 2, 2.25, 2.5, 3, 4, 5, 6, 7, 8, 9, 10, 12, or 15 degrees, as examples, for instance, degrees F. or C.

In a number of embodiments, act 405 of modulating the control valve and maintaining the temperature (e.g., of the water entering) the (e.g., at least one) chilled beam at least the predetermined temperature differential above the dew point within the zone includes using a first PID loop, for instance. Moreover, in certain embodiments, act 405 of automatically modulating the (e.g., at least one chilled-water) control valve includes maintaining the space temperature within the zone (e.g., measured in act 402) relative to a set-point temperature (e.g., entered by a user into thermostat 195, 3195, 3295, 3395, or into controller 190, 3190, 3290, 3390, or 390) by maintaining the temperature of the water entering the (e.g., at least one) chilled beam at the predetermined temperature differential above the dew point within the zone when the space temperature within the zone exceeds the set-point temperature and by increasing the temperature of the water entering the (e.g., at least one) chilled beam when the space temperature within the zone is below the set-point temperature. In this context, "increasing the temperature" can be accomplished by reducing the amount of chilled water delivered to the (e.g., at least one) chilled beam, for example. The amount of chilled water that is delivered to the (e.g., at least one) chilled beam can be reduced, for instance, by recirculating water through the (e.g., at least one) chilled beam in the zone rather than by circulating chilled water from the chilled-water distribution system (e.g., 340) into the (e.g., at least one) chilled beam in the zone.

In the embodiment illustrated, method 400 further includes act 406, for instance, when the space temperature (e.g., measured in act 402) falls below the set-point temperature, of slowing the zone pump (e.g., 160, 316, 326, or 336), for example, to reduce energy consumption of the zone pump. In such embodiments, the zone pump may be a multi-speed pump, for example, a variable-speed pump. Moreover, in the embodiment illustrated, method 400 further includes act 407, for instance, when the space temperature (e.g., measured in act 402) exceeds the set-point temperature, of accelerating the zone pump (e.g., 160, 316, 326, or 336), for example, increasing cooling capacity of the (e.g., at least one) chilled beam. In a number of embodiments, act 407 of accelerating the zone pump, for example, increasing cooling capacity of the (e.g., at least one) chilled beam, includes using a second PID loop to control the speed of the zone pump to maintain the space temperature within the zone relative to the set-point temperature. Further, act 406, 407, or both, may be initiated or controlled by controller 190, 3190, 3290, 3390, or 390, as examples. In a number of embodiments, acts 406 and 407 may alternate over time to reduce energy consumption of the zone pump, or to increase cooling capacity of the (e.g., at least one) chilled beam, as appropriate at the time, for instance, depending on loading within the zone. In a number of embodiments, accelerating the zone pump, in act 407, increases capacity by evening out the temperature of the chilled beam rather than having the chilled beam be colder at the inlet than at the outlet.

In a number of embodiments, act 405 of (e.g., automatically) modulating the (e.g., at least one chilled-water) control valve (e.g., 191, 319, 329, or 339) includes maintaining the space temperature within the zone (e.g., measured in act 402) relative to the set-point temperature by lowering the temperature of the water entering the (e.g., at least one) chilled beam (e.g., 170, 311, 321, or 331) without bringing the temperature of the water entering the (e.g., at least one) chilled beam below the predetermined temperature differential above the dew point within the zone when the space temperature within the zone exceeds the set-point temperature, and by increasing the temperature of the water entering the (e.g., at least one) chilled beam when the space temperature within the zone is below the set-point temperature. Moreover, in a number of embodiments, act 407 of accelerating the zone pump to increase cooling capacity of the (e.g., at least one) chilled beam is performed only when the temperature of the water entering the (e.g., at least one) chilled beam is at or within the predetermined temperature differential above the dew point within the zone. Furthermore, in a number of embodiments, act 401 of operating the zone pump serving the zone includes operating only one zone pump (e.g., 160, 316, 326, or 336) per zone (e.g., 310, 320, or 330). In various embodiments, the one zone pump (e.g., 160, 316, 326, or 336) both recirculates water through the (e.g., at least one) chilled beam in the zone and circulates chilled water from the chilled-water distribution system into the (e.g., at least one) chilled beam in the zone. In many embodiments, however, each zone (e.g., 310, 320, and 330) may have a zone pump (e.g., 316, 326, and 336, respectively) and the different zone pumps for the different zones may operate (e.g., in act 401) at the same time.

FIG. 4 illustrates an example of the order that the acts depicted can be performed in, but in many embodiments, acts may be performed in a different order or in any feasible order. Acts may be repeated, performed at the same time, or the like, in a number of embodiments, as would be apparent to a person of ordinary skill in the art. Further, different embodiments can include some or all of the acts of method 400, can include other acts, or a combination thereof, as examples.

This disclosure illustrates, among other things, examples of certain embodiments of the invention and particular aspects thereof. Other embodiments may differ. Various embodiments may include aspects shown in the drawings, described in the text, shown or described in other documents that are identified, known in the art, or a combination thereof, as examples. Moreover, certain procedures may include acts such as obtaining or providing various structural components described herein and obtaining or providing components that perform functions described herein. Furthermore, various embodiments include advertising and selling products that perform functions described herein, that contain structure described herein, or that include instructions to perform acts or functions described herein, as examples. The subject matter described herein also includes various means for accomplishing the various functions or acts described herein or that are apparent from the structure and acts described. Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

Further, other embodiments include a building that includes an air conditioning unit or HVAC unit or system described herein. Various methods in accordance with different embodiments include acts of selecting, making, positioning, assembling, or using certain components, as examples. Other embodiments may include performing other of these acts on the same or different components, or may include fabricating, assembling, obtaining, providing, ordering, receiving, shipping, or selling such components, or other components described herein or known in the art, as other examples. Further, different embodiments include various combinations of the components, features, and acts described herein or shown in the drawings, for example. Other embodiments may be apparent to a person of ordinary skill in the art having studied this document.

What is claimed is:

1. A chilled beam air conditioning system for cooling a space the chilled beam air conditioning system comprising:

a chilled-water distribution system;

at least one chilled beam;

a conduit for passing water wherein:

the conduit comprises: a supply portion that supplies the water to the at least one chilled beam; and a return portion that returns the water from the at least one chilled beam;

the return portion is connected to the supply portion and the water recirculates from the return portion to the supply portion to control temperature of the at least one chilled beam;

a chilled-water inlet connecting the chilled-water distribution system to the supply portion of the conduit;

a chilled-water outlet connecting the return portion of the conduit to the chilled-water distribution system;

a chilled water control valve located in the chilled-water inlet or in the chilled-water outlet wherein the chilled water control valve controls flow of the water between the chilled-water distribution system and the conduit;

a pump mounted in the conduit wherein the pump:

circulates the water from the chilled-water distribution system through: the chilled-water inlet, the supply portion of the conduit, the at least one chilled beam, the return portion of the conduit, and the chilled-water outlet to the chilled-water distribution system to cool the at least one chilled beam; and recirculates the water from the return portion of the conduit to the supply portion of the conduit to control temperature of the at least one chilled beam;

a water temperature sensor that measures water temperature entering the at least one chilled beam;

a space temperature sensor;

a space humidistat; and a digital controller specifically configured to control at least the chilled water control valve based upon input from the water temperature sensor and the space humidistat to control temperature of the water delivered to the at least one chilled beam to keep the water temperature entering the at least one chilled beam above a present dew point temperature within the space.

2. The chilled beam air conditioning system of claim 1 comprising multiple zones wherein each zone of the multiple zones comprises at least one of:

the at least one chilled beam;

the water temperature sensor;

the space temperature sensor;

the space humidistat; and a chilled beam pump module comprising at least one of:

the conduit;

the chilled-water inlet;

the chilled-water outlet;

the chilled water control valve; and the pump.

3. The chilled beam air conditioning system of claim 2 wherein:

each zone of the multiple zones further comprises one of the digital controller;

the chilled-water distribution system comprises at least one chilled water circulation pump, at least one chiller, and a chilled water loop, wherein the chilled water circulation pump circulates chilled water through the at least one chiller and through the chilled water loop;

each chilled beam of the at least one chilled beam is one of a passive chilled beam or an active chilled beam, wherein the passive chilled beam incorporates a chilled coil or plate and relies on natural convection and radiant heat transfer to condition space in the zone including cool air flowing downward to the space in a reverse chimney effect, and, for the active chilled beam, primary airflow is delivered through slots or nozzles causing induction of room air through an integrated coil in the active chilled beam;

in each zone of the multiple zones, the pump is mounted in the supply portion of the conduit or in the return portion of the conduit; and the digital controller is further specifically configured to control at least the chilled water control valve based upon input from the space temperature sensor to control temperature of the water delivered to the at least one chilled beam to control temperature of the space relative to a set-point temperature.

4. The chilled beam air conditioning system of claim 1 wherein one of the chilled-water inlet or the chilled-water outlet comprises a check valve.

5. The chilled beam air conditioning system of claim 1 further comprising:

a warm-water inlet for connecting a warm-water distribution system to the supply portion of the conduit; and a warm-water outlet for connecting the return portion of the conduit to the warm water distribution system.

6. The chilled beam air conditioning system of claim 1 further comprising:

a warm-water distribution system comprising at least one warm water circulation pump, at least one water heater, and a warm water loop, wherein the warm water circulation pump circulates warm water through the at least one water heater and through the warm water loop;

a warm-water inlet connecting the warm-water distribution system to the supply portion of the conduit;

a warm-water outlet connecting the return portion of the conduit to the warm water distribution system; and a warm water control valve located in the warm-water inlet or in the warm-water outlet wherein the warm water control valve controls flow of the water between the warm-water distribution system and the conduit;

wherein one of the chilled-water control valve or the warm-water control valve is connected to the supply portion of the conduit and another of the chilled-water control valve or the warm-water control valve is connected to the return portion of the conduit.

7. The chilled beam air conditioning system of claim 6 wherein:

one of the chilled-water inlet or the warm-water inlet comprises a first check valve; and one of the chilled-water outlet or the warm-water outlet comprises a second check valve.

8. The chilled beam air conditioning system of claim 1 wherein: the pump is a multiple-speed pump and the digital controller controls speed of the pump including, when operating in a cooling mode:

slowing the pump to reduce energy consumption of the pump when space temperature, input from the space temperature sensor, is below a set-point temperature; and accelerating the pump to increase cooling capacity of the at least one chilled beam by evening out temperature of the at least one chilled beam when the space temperature is above the set-point temperature.

9. The chilled beam air conditioning system of claim 1 wherein:

the at least one chilled beam comprises an active chilled beam;

the chilled beam air conditioning system further comprises an outside air delivery system that delivers outside air to the active chilled beam;

the outside air delivery system removes humidity from the outside air in the outside air delivery system before delivery to the active chilled beam; and the chilled beam air conditioning system uses the input from the space humidistat to control how much humidity is removed from the outside air in the outside air delivery system.

10. The chilled beam air conditioning system of claim 1 wherein the chilled-water distribution system comprises only one chilled water loop rather than a chilled water supply loop and a separate chilled water return loop.

11. A method of controlling at least one chilled beam in a zone of an air conditioning system, wherein the at least one chilled beam is cooled with chilled water, the method comprising at least the acts of:

operating a zone pump serving the zone that both recirculates water through the at least one chilled beam and circulates chilled water from a chilled-water distribution system into the at least one chilled beam;

measuring space temperature within the zone;

determining a present dew point temperature within the zone;

measuring temperature of water entering the at least one chilled beam; and automatically modulating at least one chilled-water control valve including regulating how much water passing through the zone pump is recirculated through the at least one chilled beam and how much of the water passing through the zone pump is circulated from the chilled-water distribution system, wherein the act of automatically modulating the at least one chilled-water control valve comprises maintaining the temperature of the water entering the at least one chilled beam at least a predetermined temperature differential above the present dew point temperature within the zone.

12. A controllable chilled-beam pump module for controlling at least one zone of a chilled-beam air conditioning system, the controllable chilled-beam pump module comprising:

a conduit through which water passes wherein:

the conduit comprises a supply portion supplying the water to at least one chilled beam located within the at least one zone of the chilled-beam air conditioning system;

the conduit comprises a return portion returning the water from the at least one chilled beam;

the return portion is connected to the supply portion;

the water recirculates within the conduit from the return portion to the supply portion and through the at least one chilled beam to control a temperature of the water entering the at least one chilled beam;

a pump mounted in the conduit that circulates the water through the conduit and through the at least one chilled beam and recirculates the water within the conduit from the return portion to the supply portion to control the temperature of the water entering the at least one chilled beam;

a chilled-water control valve that controls exchange of the water between a chilled-water distribution system and the conduit wherein the chilled-water control valve is connected to the supply portion of the conduit or to the return portion of the conduit;

a digital controller that:

receives measured space temperature from within the at least one zone;

receives measured humidity, dew point, or a parameter that can be used to calculate humidity or dew point, from within the at least one zone;

receives measured temperature of the water entering the at least one chilled beam; and when the at least one zone is operating in a cooling mode, automatically modulates the chilled-water control valve including regulating how much of the water passing, through the pump is recirculated through the at least one chilled beam and how much of the water passing through the pump is circulated from the chilled-water distribution system, including maintaining the temperature of the water entering the at least one chilled beam at least a predetermined temperature differential above the dew point within the at least one zone.

13. The controllable chilled-beam pump module of claim 12 wherein the pump is a multiple-speed pump and wherein the digital controller controls speed of the pump including, in the cooling mode:

slowing the pump to reduce energy consumption of the pump when the measured space temperature is below a set-point temperature; and accelerating the pump to increase cooling capacity of the at least one chilled beam by evening out temperature of the at least one chilled beam when the measured space temperature is above the set-point temperature.

14. The controllable chilled-beam pump module of claim 12 further comprising a chilled-water check valve that controls exchange of the water between the chilled-water distribution system and the conduit wherein the chilled-water check valve is connected to the supply portion of the conduit or to the return portion of the conduit.

15. The controllable chilled-beam pump module of claim 14 wherein the chilled-water check valve equalizes pressure between a warm-water distribution system and the chilled-water distribution system to prevent excessive buildup of pressure within the warm-water distribution system due to expansion from increasing temperature.

16. The controllable chilled-beam pump module of claim 12 further comprising:

a chilled-water inlet that, connects the chilled-water distribution system to the supply portion of the conduit; and a chilled-water outlet that connects the return portion of the conduit to the chilled-water distribution system;

wherein the chilled-water control valve is located in the chilled water inlet or the chilled water outlet.

17. The controllable chilled-beam pump module of claim 16 further comprising:

a warm-water inlet for connecting a warm-water distribution system to the supply portion of the conduit; and a warm-water outlet for connecting the return portion of the conduit to the warm-water distribution system.

18. The controllable chilled-beam pump module of claim 12 further comprising the at least one chilled beam located within the at least one zone of the chilled-beam heating and air conditioning system wherein: the at least one chilled beam comprises a passive chilled beam incorporating a chilled coil or plate and relying on natural convection and radiant heat transfer to condition the at least one zone including cooling air flowing downward in the at least one zone in a reverse chimney effect.

19. The controllable chilled-beam pump module of claim 12 further comprising the at least one chilled beam located within the at least one zone of the chilled-beam heating and air conditioning system wherein: the at least one chilled beam comprises an active chilled beam wherein air is delivered through slots or nozzles causing induction of room air through an integrated coil in the active chilled beam.

20. The controllable chilled-beam pump module of claim 12 wherein, when the at least one zone is operating in a heating mode, the digital controller receives the measured space temperature from within the at least one zone and automatically controls how much of the water passing through the pump is recirculated within the conduit from the return portion to the supply portion to control the temperature of the water entering the at least one chilled beam to control the space temperature.

* * * * *